US006116160A

United States Patent [19]

Burnett et al.

[11] Patent Number: 6,116,160

[45] Date of Patent: Sep. 12, 2000

[54] PRINTER DRUM

[75] Inventors: Scott T. Burnett, Derry, N.H.; James D. Roberge, Westford, Mass.; Adam I. Pinard, Carlisle, Mass.; Robert J. Bullock, Acton, Mass.; David A. Parker, Dunstable, Mass.

[73] Assignee: IRIS Graphics, Inc., Bedford, Mass.

[21] Appl. No.: 09/042,032

[22] Filed: Mar. 13, 1998

[51] Int. Cl.[7] ..... B41F 13/10

[52] U.S. Cl. ..... 101/378; 101/415.1

[58] Field of Search ..... 101/375, 378, 101/382.1, 383, 407.1, 408, 409, 410, 415.1, 246; 492/25, 36, 38, 39, 40

[56] References Cited

U.S. PATENT DOCUMENTS

| | | | |
|---|---|---|---|
| 2,386,214 | 10/1945 | Harrold et al. . | |
| 2,844,123 | 7/1958 | Hayford . | |
| 3,154,012 | 10/1964 | Fischer . | |
| 3,217,644 | 11/1965 | Schmidt . | |
| 3,735,702 | 5/1973 | Kossak . | |
| 3,781,107 | 12/1973 | Ruhland . | |
| 4,018,158 | 4/1977 | Borneman . | |
| 4,024,814 | 5/1977 | Becker | 101/410 |
| 4,026,209 | 5/1977 | Wirz et al. | 101/410 |
| 4,135,198 | 1/1979 | Fujimoto . | |
| 4,191,106 | 3/1980 | Fermi et al. . | |
| 4,202,268 | 5/1980 | Becker . | |
| 4,204,471 | 5/1980 | Becker . | |
| 4,223,604 | 9/1980 | Brehm et al. . | |
| 4,225,872 | 9/1980 | Marinoff . | |
| 4,250,810 | 2/1981 | Fowler et al. . | |
| 4,304,182 | 12/1981 | Etchell et al. . | |
| 4,332,197 | 6/1982 | Dulin . | |
| 4,334,473 | 6/1982 | Becker et al. | 101/409 |
| 4,489,653 | 12/1984 | Cappel et al. . | |
| 4,864,931 | 9/1989 | Felkl et al. . | |
| 4,938,135 | 7/1990 | Wieland . | |
| 4,953,252 | 9/1990 | Akisawa . | |
| 5,052,299 | 10/1991 | Kojima . | |
| 5,086,701 | 2/1992 | Gasparrini et al. . | |
| 5,123,354 | 6/1992 | Loos . | |
| 5,181,469 | 1/1993 | Merkel et al. . | |
| 5,322,014 | 6/1994 | Keller . | |
| 5,325,778 | 7/1994 | Hartung et al. . | |
| 5,335,046 | 8/1994 | Bosy . | |
| 5,335,597 | 8/1994 | Helmstadter | 101/410 |
| 5,584,242 | 12/1996 | Fuller et al. . | |
| 5,685,226 | 11/1997 | Fuller . | |

FOREIGN PATENT DOCUMENTS

| | | | |
|---|---|---|---|
| 0005715 | 12/1979 | European Pat. Off. . | |
| 0236741 | 9/1987 | European Pat. Off. . | |
| 0 246 012 | 11/1987 | European Pat. Off. . | |
| 2 474 899 | 8/1981 | France . | |
| 609099 | 1/1935 | Germany . | |
| 2016847 | 12/1971 | Germany . | |
| 3319246 A1 | 12/1984 | Germany . | |
| 301351 A1 | 7/1985 | Germany . | |
| 29616704 | 11/1996 | Germany . | |
| 148058 | 7/1986 | Japan | 101/410 |
| 562687 | 6/1975 | Switzerland . | |

*Primary Examiner*—Ren Yan
*Attorney, Agent, or Firm*—Fish & Richardson, P.C.

[57] ABSTRACT

A printer drum includes a leading edge assembly for holding a first end of a substrate, and a trailing edge assembly for holding a second end of the substrate. The leading edge assembly includes a first plurality of interconnected disks, and the trailing edge assembly includes a second plurality of interconnected disks. The disks of the two assemblies are interleaved such that the disks of the trailing edge assembly are rotatable relative to the disks of the leading edge assembly about the axis of rotation of the drum. A balancing disk is interleaved with the disks. A leading edge clamp interconnects the first plurality of disks, and a trailing edge clamp interconnects the second plurality of disks. A plurality of registration pins of the leading edge clamp selectively engage a substrate held by the clamp.

28 Claims, 11 Drawing Sheets

PRINTER DRUM

BACKGROUND OF THE INVENTION

This invention relates to a printing drum.

As described in Kellett, U.S. Ser. No. 08/645,747, titled MATERIALS USEFUL IN LITHOGRAPHIC PRINTING PLATES, filed May 14, 1996, incorporated by reference herein, a continuous jet printer can be used to prepare a printing plates for offset printing. Typically in offset printing, four separate aluminum plates are used to produce a single color image. Each of the four plates is engraved with a partial image used to print one of four colors: cyan, magenta, yellow and black. Because four plates are used to produce a single image, the partial images must be precisely aligned on the drum and on the printing press.

SUMMARY OF THE INVENTION

According to one aspect of the invention, a printer drum includes a leading edge assembly for holding a first end of a substrate, and a trailing edge assembly for holding a second end of the substrate. The leading edge assembly includes a first plurality of interconnected disks, and the trailing edge assembly includes a second plurality of interconnected disks. The disks of the two assemblies are interleaved such that the disks of the trailing edge assembly are rotatable relative to the disks of the leading edge assembly about the axis of rotation of the drum.

Embodiments of this aspect of the invention may include one or more of the following features.

The axis of rotation of the drum is a common central axis of the disks of both assemblies. Each disk defines a centric hole and an axle extends along the axis of rotation and through each centric hole. The axle is fixedly connected to the leading edge assembly such that rotation of the axle causes rotation of the leading edge assembly. A rotation lock prevents the disks of the trailing edge assembly from rotating with respect to the disks of the leading edge assembly.

Each disk defines a through hole located between a center of the disk and a circumference of the disk for containing a balancing weight such that a center of mass of the leading edge assembly and a center of mass of the trailing edge assembly lie along the axis of rotation.

In certain embodiments, a balancing disk is interleaved with the disks. The balancing disk includes an adjustably positioned balancing weight for compensating for the weight of a printing plate attached to the drum. The balancing disk is a disk of the leading edge assembly. The balancing disk includes a central member, a first ring rotatably mounted to a first side of the central member, and a second ring rotatably mounted to a second side of the central member. The balancing weight includes a weight fixedly mounted to the first ring and a weight fixedly mounted to the second ring.

A leading edge clamp interconnects the first plurality of disks, and a trailing edge clamp interconnects the second plurality of disks. The disks are generally circular in shape and each disk defines a relieved section along a portion of the circumference of the disk. The relieved section provides clearance for the clamps during rotation of the leading edge clamp relative to the trailing edge clamp.

The disks define a continuous printing plate support surface. The disks of both assemblies are substantially identical. Each disk has a first side and an opposing second side. When interleaved the disks of the second plurality are reversed with respect to the disks of the first plurality such that the first side of a disk of the first plurality faces the first side of a disk of the second plurality.

The leading edge assembly includes a third plurality of disks. A second trailing edge assembly has a fourth plurality of disks interleaved with the third plurality of disks and rotatable relative to the leading edge assembly about the axis of rotation.

According to another aspect of the invention, a clamp for holding a substrate includes a base, a clamping member elastically deformable between a clamping position and a non-clamping position, and an actuator movable between a first position and a second position. The base supports a first side of the substrate, and the clamping member in the clamping position presses against a second side of the substrate. The actuator is in contact with the clamping member when the actuator is in the second position such that the clamping member is elastically deformed from the clamping position to the non-clamping position. The clamping member resiliently returns to the clamping position when the actuator is moved to its first position.

Embodiments of this aspect of the invention may include one or more of the following features.

The clamping member is a c-shaped clamp. The actuator is an eccentric rod located in a channel defined by the base. A plurality of registration pins are connected to the base and movable relative to the base to selectively engage a substrate held by the clamp.

According to another aspect of the invention, a clamp for registering a variety of substrates having differently spaced registration notches to a printing assembly includes a clamp base defining a surface and a plurality of spaced registration pins connected to the clamp base. The registration pins are independently selectively deployable to extend from the base surface and engage the spaced registration notches of a substrate. Only those registration pins having spacing therebetween which corresponds with the spacing of the substrate notches are deployed.

Embodiments of this aspect of the invention may include one or more of the following features.

The base defines a plurality of registration holes for rotatably receiving the registration pins. Each pin defines a cam surface. The base defines a mating surface extending into each of the registration holes. The mating surface resides against the cam surface such that rotation of the pin causes the pin to move between a deployed position in which the pin extends into the substrate notch and a non-deployed position in which the pin is spaced from the substrate notch.

Embodiments of this aspect of the invention may include a spring for biasing the registration pin toward the deployed position.

According to another aspect of the invention, a method for registering a variety of substrates having differently spaced registration notches to a printing assembly includes providing a plurality of spaced registration pins connected to a clamp of the printer assembly, and independently selectively deploying only those registration pins having spacing therebetween which corresponds with the spacing of the substrate notches to extend from the clamp and engage the spaced notches of the substrate.

Among other advantages, the printing drum is easy to adjust for clamping of different sized printing plates to the drum. The disks of the drum provide continuous support of the printing plate. The drum can be made to any desired length to hold various width plates and to hold more than one plate at a time. The plurality of deployable registration pins allow different sized plates to be precisely located on the drum.

Other features and advantages of the invention will be apparent from the following detailed description, and from the claims.

DESCRIPTION OF THE PREFERRED EMBODIMENT

Figure 1:
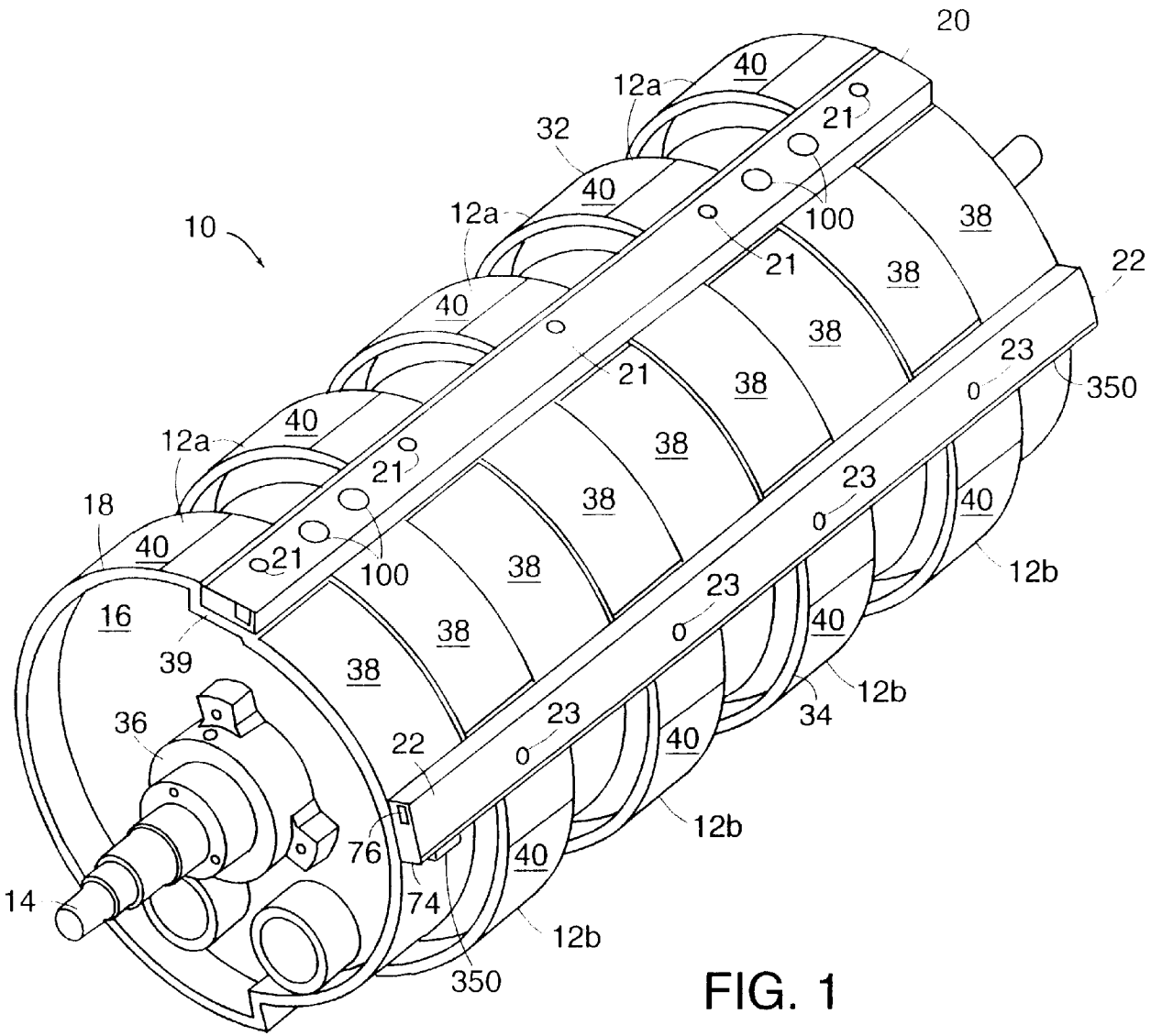
FIG. 1 is a perspective view of a printing drum assembly of the invention.
Figure 2A:
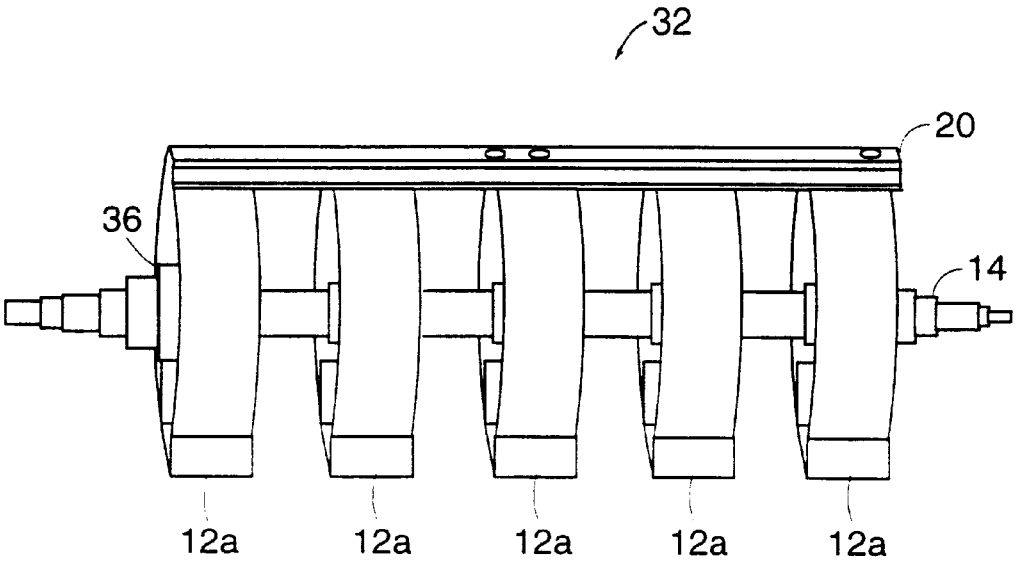
FIG. 2A shows a leading edge assembly of the printing drum assembly of FIG. 1.
Figure 2B:
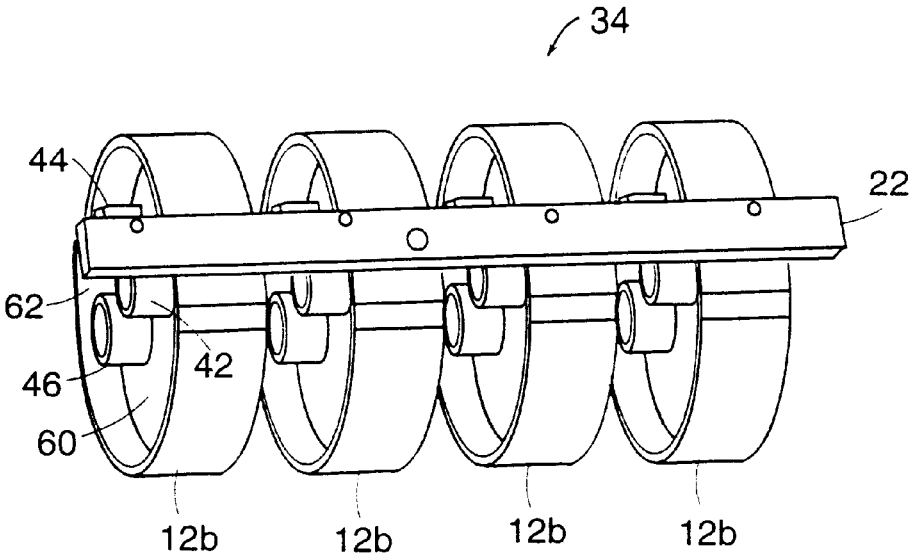
FIG. 2B shows a trailing edge assembly of the printing drum assembly of FIG. 1.

Referring to FIGS. 1, 2A and 2B, a printing drum assembly 10 of a continuous jet printer for clamping and rotating various sized printing plates includes a leading edge assembly 32 and a trailing edge assembly 34 rotatable with respect to leading edge assembly 32. Leading edge assembly 32 includes a series of spaced disks 12*a*, here five disks 12*a* are shown, interconnected by a leading edge plate clamp 20 with bolts 21. Trailing edge assembly 34 includes a second series of spaced disks 12*b*, here four disks 12*b* are shown, interconnected by a trailing edge plate clamp 22 with bolts 23.

Disks 12*a* are fixedly mounted to an axle 14 to rotate with the axle, as described further below. When assembled, disks 12*a* and 12*b* are interleaved as shown in FIG. 1, and disks 12*b* are rotatably mounted to axle 14 such that the trailing edge assembly 34 can be rotated about the axle. This ability to rotate the trailing edge assembly about axle 14 enables the user to adjust the distance between leading edge plate clamp 20 and trailing edge plate clamp 22 to accommodate different length printing plates.

Figures 3A, 4, 5:
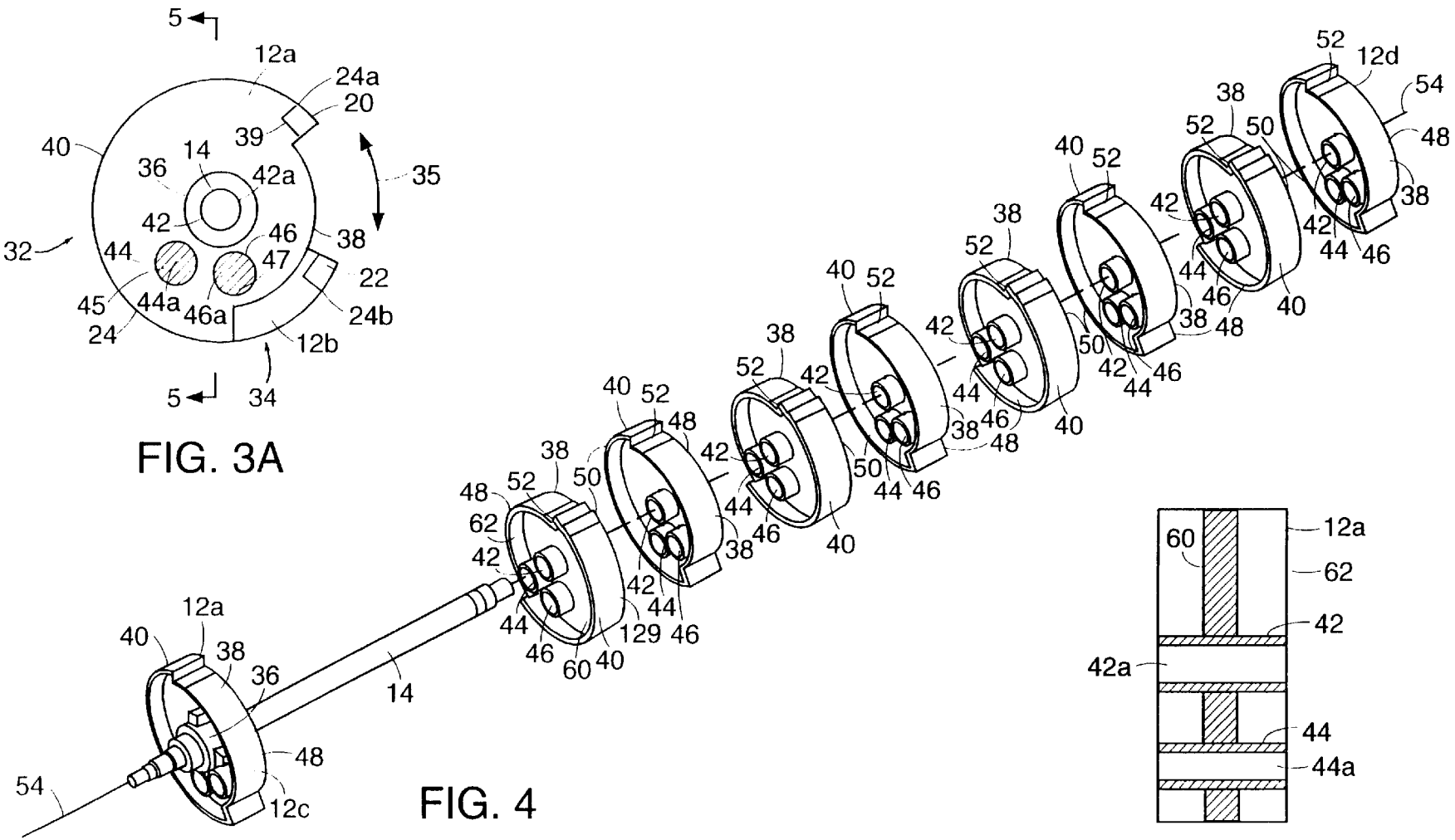
FIG. 3A is an end view of the printing drum assembly of FIG. 1 shown with a printing plate mounted to the drum assembly.
FIG. 4 is an exploded view of the printing drum assembly of FIG. 1.
FIG. 5 is a cross-sectional side view of single disk of the printing drum assembly of FIG. 1, taken along lines 5—5 in FIG. 3A.

Referring to FIG. 3A, a flexible printing plate 24 includes a leading edge 24*a* and a trailing edge 24*b*. Printing plate 24 is supported along its entire length on plate support surfaces 40 of disks 12*a*, 12*b* with leading edge 24*a* held securely by leading edge plate clamp 20 and trailing edge 24*b* held securely by trailing edge plate clamp 22. To mount a different length printing plate to drum assembly 10, trailing edge assembly 34 is simply rotated, arrow 35, with respect to leading edge assembly 32 to place clamps 20, 22 the desired distance apart about the circumference of the drum assembly. Once the clamps are at their desired spacing, trailing edge assembly 34 is locked in position, as described further below.

Referring also to FIG. 4, for ease in manufacturing, disks 12*a* and 12*b* are injection molded from the same mold such that all of the disks have the same shape. Each disk 12*a*, 12*b* has a first side 48 and a second side 50. When assembled, disks 12*b* are flipped with respect to disks 12*a*, with the first side of a disk 12*a* facing the first side of a disk 12*b* and the second side of a disk 12*a* facing the second side of a disk 12*b*.

Disks 12*a*, 12*b* are generally circular in shape with a recessed arcuate region 38 that extends along approximately 40% of the circumference of the disk. An outward step 39 in recessed region 38 provides a mounting surface for one of the respective clamps 20, 22. The recessed area 38 provides clearance for clamps 20, 22 when trailing edge assembly 34 is rotated with respect to leading edge assembly 32.

Referring also to FIG. 5, each disk 12*a*, 12*b* includes a central plate 60 and a wall 62 extending from either side of plate 60. Also extending from either side of plate 60 is an axle sleeve 42 and two balancing weight sleeves 44, 46. Each sleeve 42, 44, 46 defines a through hole, 42*a*, 44*a*, 46*a*, respectively. Through hole 42*a* is aligned with an axis of rotation 54 of drum assembly 10, and is sized slightly larger in diameter than the diameter of axle 14 to receive axle 14.

Leading edge assembly 32 is mounted to axle 14 with two hubs 36, one placed on either end of drum assembly 10. Each hub 36 is attached, e.g., by bolting, to axle 14 and to and end disk, disk 12*c* or 12*d*, of leading edge assembly 32. Rotary motion of axle 14 is transferred to disks 12*c*, 12*d* by hubs 36. The rotary motion of disks 12*c*, 12*d* is transferred by leading edge plate clamp 20 to the remainder of disks 12A. When trailing edge assembly 34 is locked to leading edge assembly 32, rotation of leading edge assembly 32 causes trailing edge assembly 34 to rotate as well.

Figure 3B:
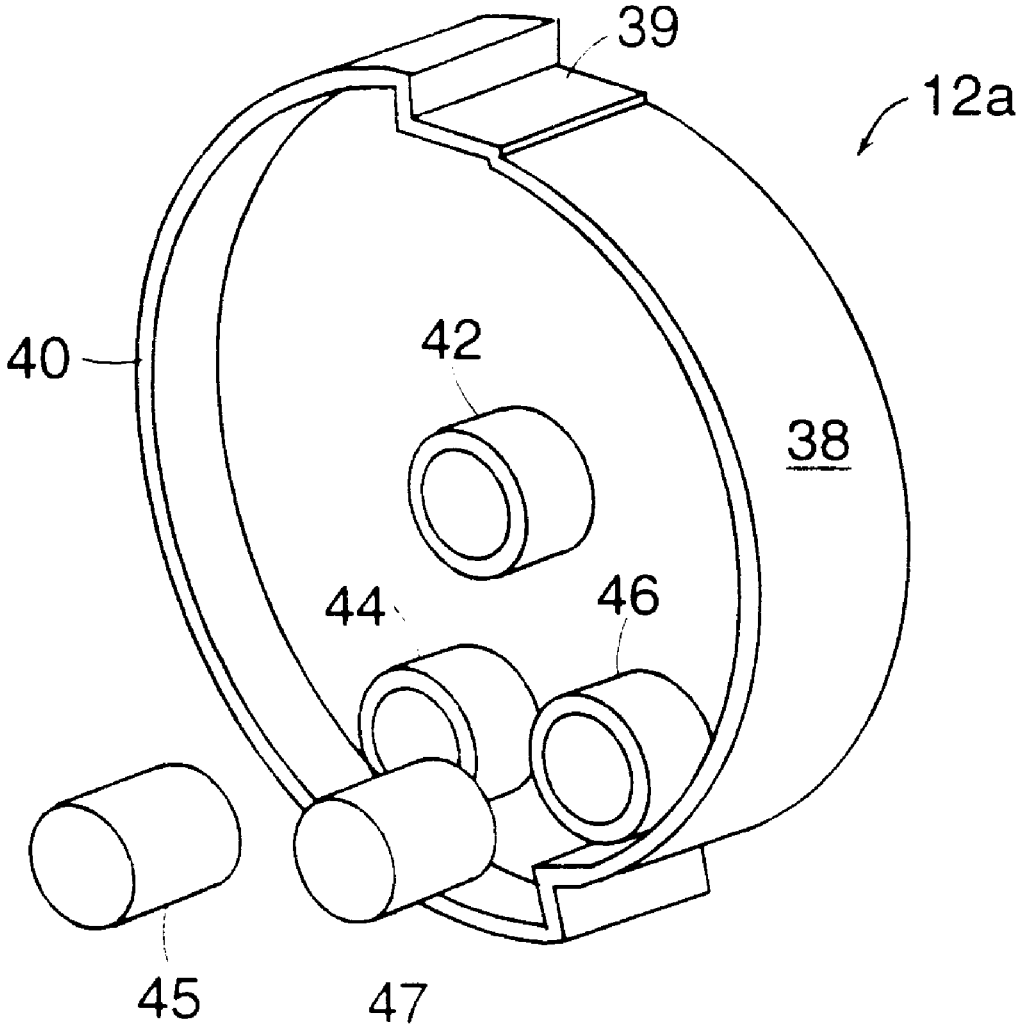
FIG. 3B is a perspective view of disk of the drum assembly.

Leading edge assembly 32 and trailing edge assembly 34 are independently balanced about axis of rotation 54 such that rotation of trailing edge assembly 34 relative to leading edge assembly 32 does not cause an imbalance in the drum. Referring to FIGS. 3A and 3B, a balancing weight 45 is secured in sleeve 44 of each disk, e.g., by an interference fit, to balance the respective assemblies. The magnitudes of the weights are selected to account for the disks and the clamp.

A balancing weight 47 having the same or a different magnitude than weight 45 can be secured in sleeve 46 to provide additional control over the magnitude and direction of the balancing force. Selection of the balancing weights can be performed by the manufacturer and need not be adjusted by the user.

It can be necessary to provide additional user adjustable balancing to account for the weight added when printing plate 24 is mounted to the drum. It is desirable to make the additional balancing adjustable since the dimensions of the plates which drum assembly 10 is adapted to receive vary. For example, the length of plate 24 typically ranges between about 14.57 inches and 21.625 inches, the width of plate 24 typically ranges between about 10.63 inches and 29 inches, and the thickness of plate 24 typically ranges between about 5 mils and 12 mils. For these size ranges, the weight of plate 24 typically ranged between about 0.07 and 0.8 pounds.

Figure 6B:
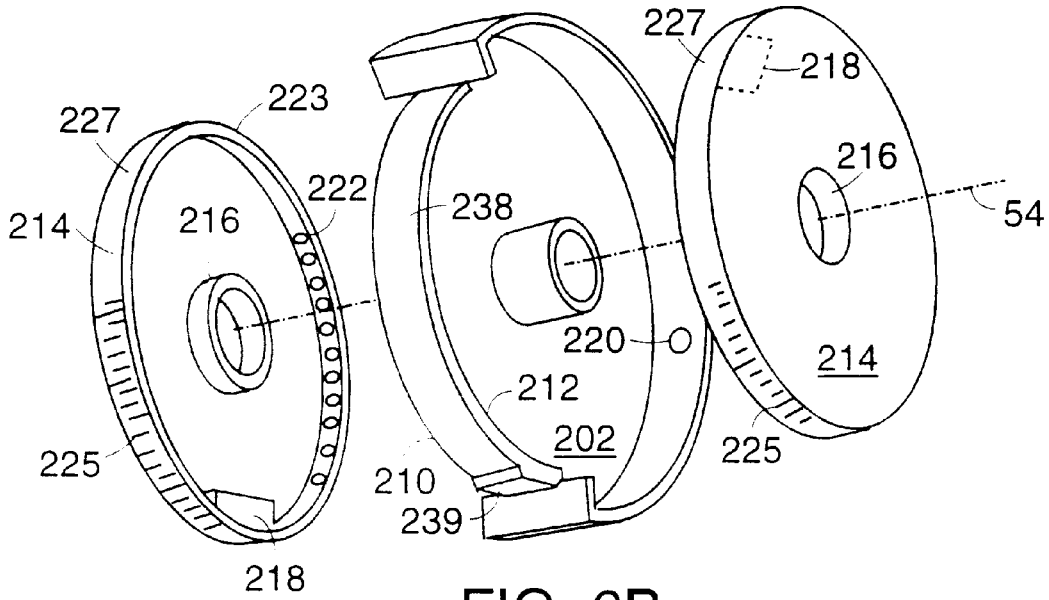
FIG. 6B is an exploded view of the balancing disk.
Figure 6A:
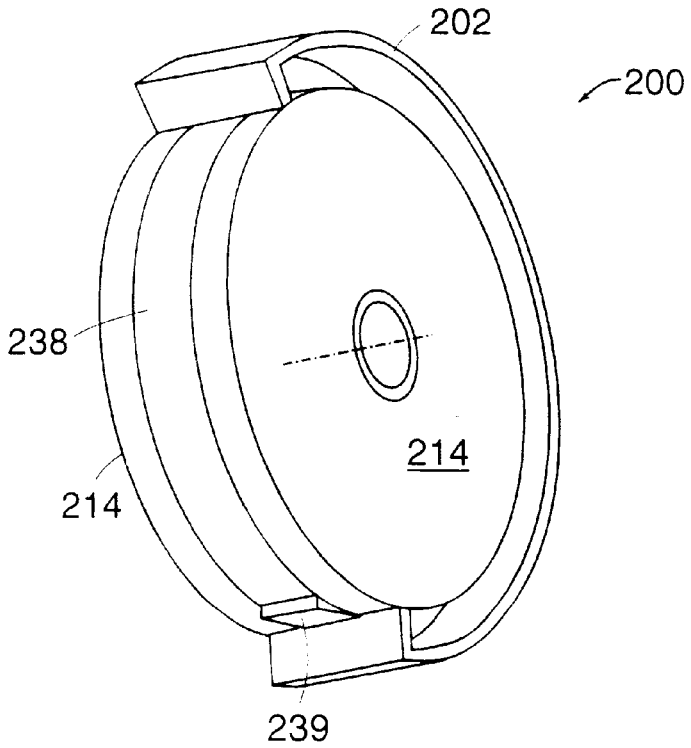
FIG. 6A is a perspective view of a balancing disk for use with the printing drum assembly of FIG. 1.

Referring to FIGS. 6A and 6B, to accommodate the varying sizes and weights of the plates which drum assembly 10 is adapted to receive, one of disks 12*a*, preferable one of the five leading edge disks which is centrally located on the drum, is replaced with a manually adjustable drum assembly 200. Drum assembly 200 includes a central disk 202 with an axle sleeve 204 defining a through hole 206 through which axle 14 is received.

As with disks 12*a* and 12*b*, disk 202 is generally circular in shape with a recessed arcuate region 238 that extends along approximately 40% of the circumference of the disk. An outward step 239 in recessed region 238 provides a mounting surface for clamp 20. The recessed area 238 provides clearance for clamp 22 when trailing edge assembly 34 is rotated with respect to leading edge assembly 32. Central disk 202 need not include balancing weight sleeves 44, 46.

Rotatably mounted by a slip fit to either side 210, 212 of disk 202 is a ring 214. Each ring 214 includes an axle sleeve 216 for receiving axle 14. A weight 218 is mounted to each ring 214 near the outer circumference of the ring. Rings 214 can be independently rotated about axis 54 to adjust the positions of weights 218, and thus the magnitude and direction of the balancing force. When the desired position of each of the rings is selected, each ring is secured in place, e.g., by engaging one of a series of detente features 222 located on an inner surface 223 of ring 214 with a spring loaded ball 220 mounted on disk 210 (only one ball 220 is shown in FIG. 6B). The lockdown detente force is selected to prevent undesirable slippage of the ring due to forces such as drum acceleration or deceleration, but also allows easy user adjustment of the ring position. Position scale 225 on the outer diameter surface 227 of each ring 214 are used to locate the positions of rings 214 relative to trailing edge clamp 22. Scale settings are identified with a call out table based on plate dimensions.

Figure 7B:
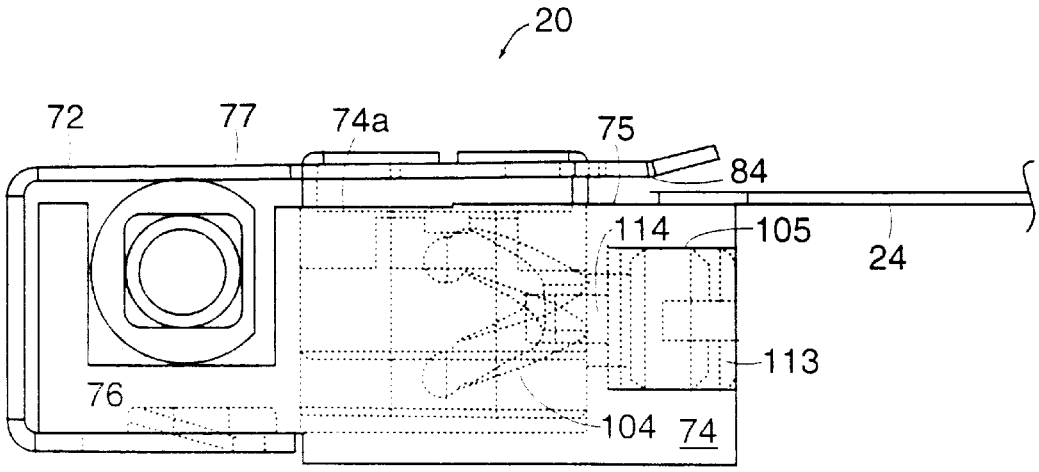
FIG. 7B is an end view of the clamp of FIG. 7A shown in an open position.
Figure 7A:
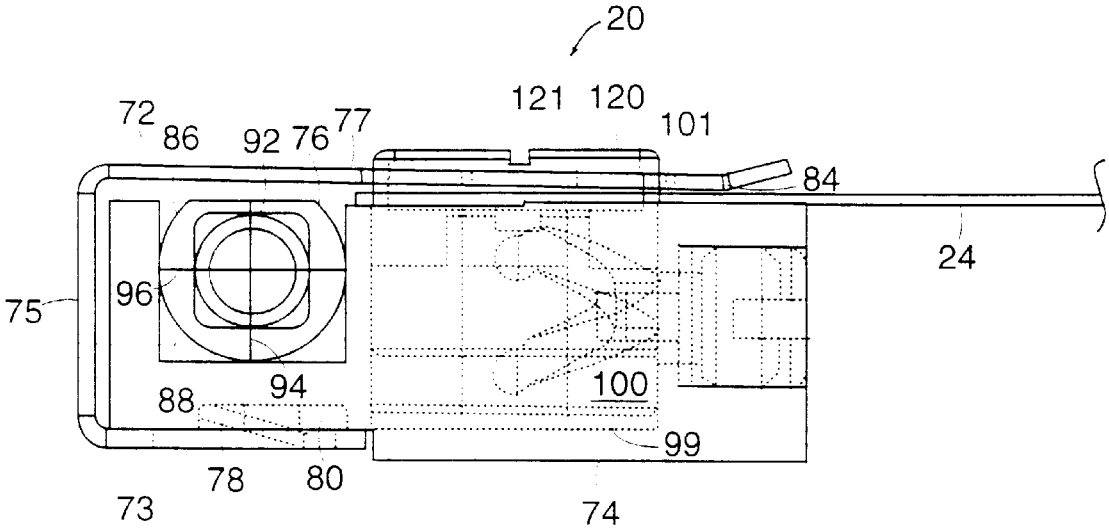
FIG. 7A is an end view of a clamp of the printing drum assembly of FIG. 1 shown in a clamping position.

Referring to FIGS. 1, 7A and 7B, clamps 20 and 22 each include a base 74, a clamping member 72 and an actuator 76. Base 74 is generally rectangular in shape and defines a clamping member mounting notch 80 and an actuator channel 88. Clamping member 72 is a c-shaped clamp formed, e.g., from 300 series tempered stainless steel. Clamping member 72 has a bottom wall 73, a side wall 75, a top wall 77. A tab 78 extends from bottom wall 73 into notch 80 to secure clamping member 72 to base 74. Clamping member 72 is prestressed such that a clamp edge 84 presses against a printing plate 24 with a predetermined clamping force necessary to hold the printing plate between clamp edge 84 and base 74. A relieved section 74*a* in base 74 aids in preventing other portions of the top wall of the clamping member from contacting the base such that the clamping force is concentrated at edge 84.

Actuator 76, e.g., an eccentric rod 86, is located in channel 88 underneath top wall 77 of clamping member 72 and extends the length of the clamp. Rod 86 has a short diameter 94 and a long diameter 96. A central key 92 of the rod accepts a handle (not shown) used to rotate the rod within channel 88. When the short diameter 94 is approximately perpendicular to top wall 77 of the clamp member (as shown in FIG. 7A), rod 86 does not contact clamp member 72 and clamp edge 84 presses against base 74. Rotation of rod 86 such that long diameter 96 is approximately perpendicular to the clamping member (as shown in FIG. 7B) causes rod 86 to engage the clamping member elastically deforming the clamping member from the clamped position shown in FIG. 7A to the open position shown in FIG. 7B in which clamp edge 84 is spaced from base 74. With the clamp in the open position, the printing plate can be slid between the clamp edge and the base. Clamps 20, 22 provide enough clamping force to hold a plate 24 during typical rotation speeds of drum 10 of about 600 rpm, and can hold the plate at speeds of up to about 1800 rpm or more.

Figure 10B:
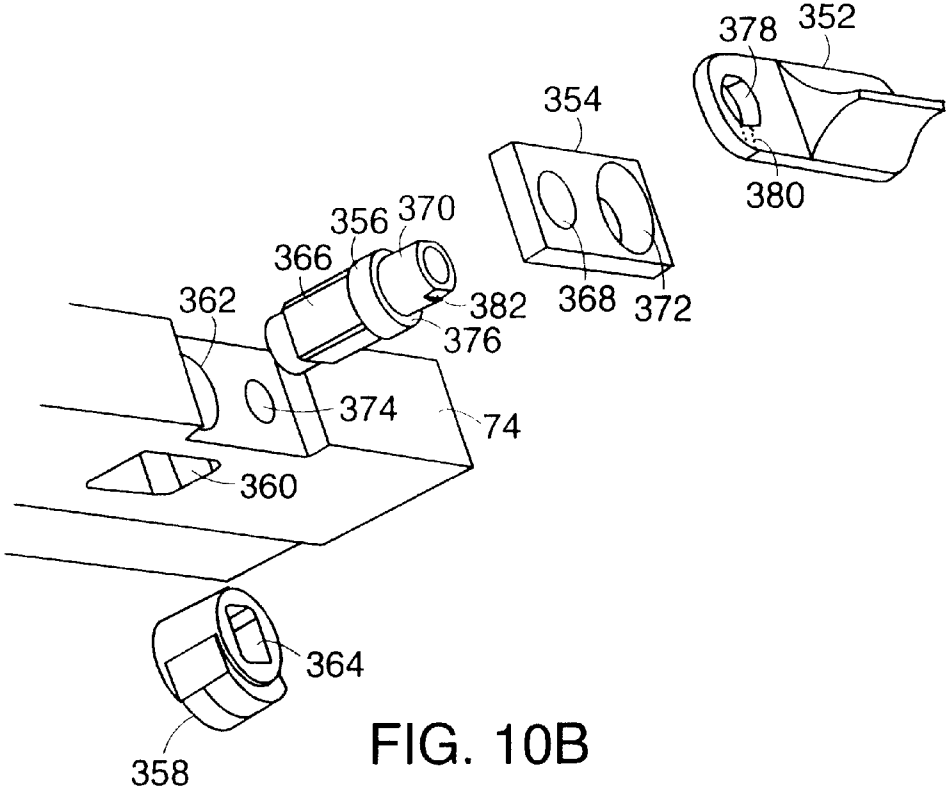
FIG. 10B is an exploded view of the trailing edge assembly lock of FIG. 10A.
Figure 10A:
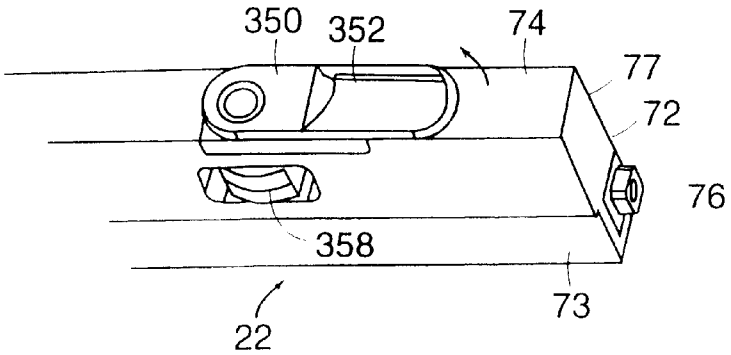
FIG. 10A is a perspective view of a trailing edge assembly lock.

Referring to FIGS. 10A and 10B, to lock trailing edge assembly 34 to leading edge assembly 32, trailing edge clamp 22 includes a lockdown mechanism 350 located at either end of the clamp. The lockdown mechanisms hold the location of the leading and trailing edge assemblies after adjustment for different plate lengths as earlier discussed. Lockdown mechanism 350 includes a handle 352, a mounting plate 354, a cam shaft 356, and an eccentric cam 358. Base 74 of clamp 22 has a slot 360 in which cam 358 is located. Shaft 356 extends through a hole 362 in base 74 which intersects slot 360 and through a square hole 364 in cam 358. Shaft 356 has a corresponding square surface 366 which causes cam 358 to rotate with shaft 356.

Mounting plate 354 has a first hole 368 through which an end 370 of shaft 356 extends. A second hole 372 in plate 354 accepts a bolt (not shown) which mounts plate 354, and thus shaft 356 and cam 358 to base 74 by threading into a hole 374 in base 74. Plate 354 abuts against a shelf 376 of shaft 356. End 376 of shaft 356 extends through a hole 378 in handle 352. Handle 352 is attached to shaft 356 by a bolt (not shown) which extends through a hole 380 in the handle and is threaded into a hole 382 in the shaft. Actuation of the locking mechanism by rotation of the handle causes the cam to extend below the bottom surface 73 of clamping member 72 and engage one of the end disks of the leading edge assembly. If, after plate loading and clamping, the plate is not in tight contact with the drum surface, the lock down mechanisms can be loosened and the clamp positions readjusted.

Figure 8:
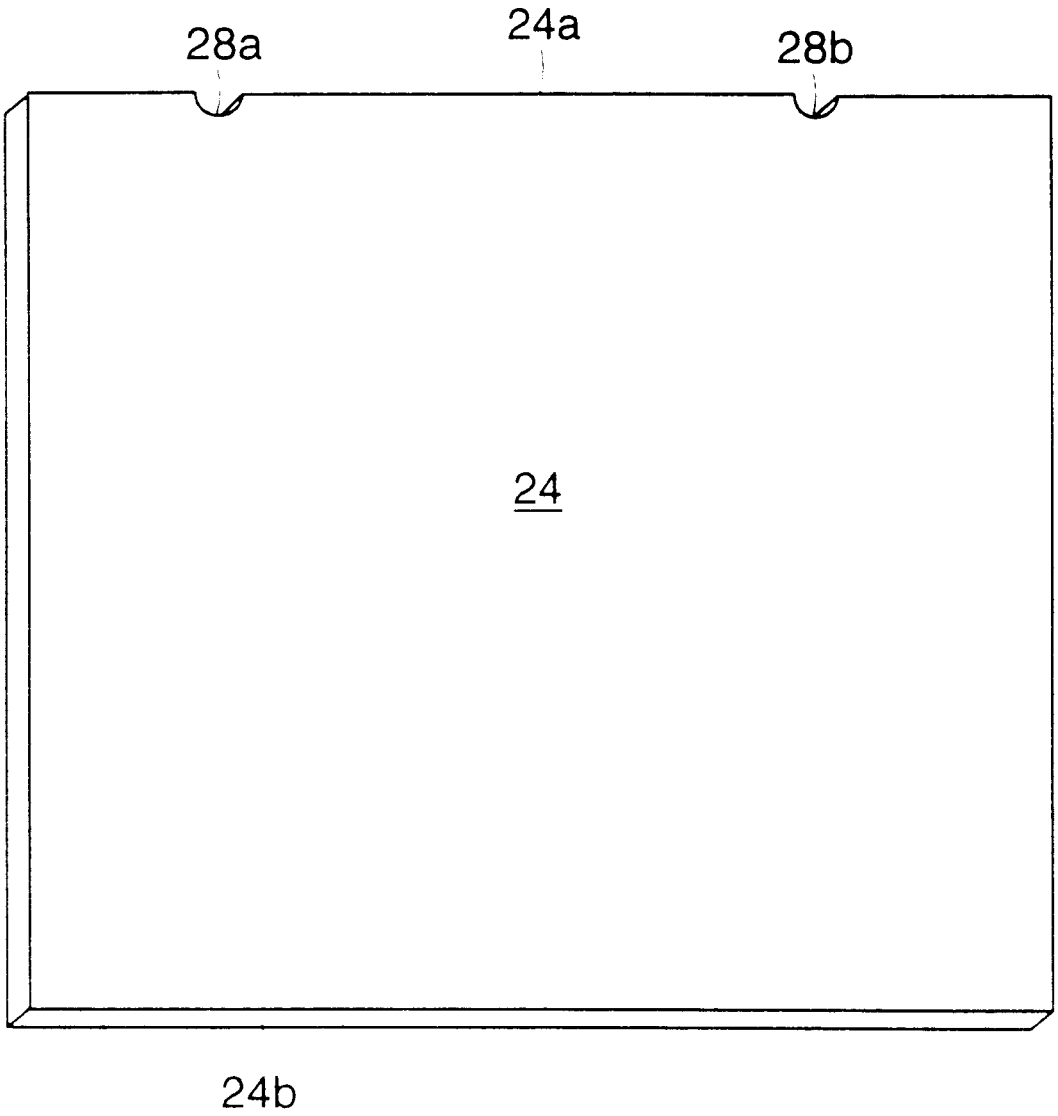
FIG. 8 shows a printing plate for use with the printing drum assembly of FIG. 1.

To provide precise registration of each of four printing plates which are engraved to receive a different color during offset printing, clamp 20 is provided with registration pins 100, here four pins 100 are shown. Base 74 defines registration pin receiving holes 99, and clamping member top wall 77 defines pin holes 101. Referring to FIG. 8, leading edge 24*a* of printing plate 24 defines press registration notches 28A and 28B. The spacing of notches 28A and 28B coincides with the spacing of a pair of the registration pins of clamp 20. The two pins are positioned to extend through a respective notch 28A, 28B, and through a respective hole 101 in clamping member 72. The remaining registration pins, whose spacings coincide with press notches of other sized printing plates, remain out of the way in a retracted position below an upper surface 75 of base 74.

Figure 9:
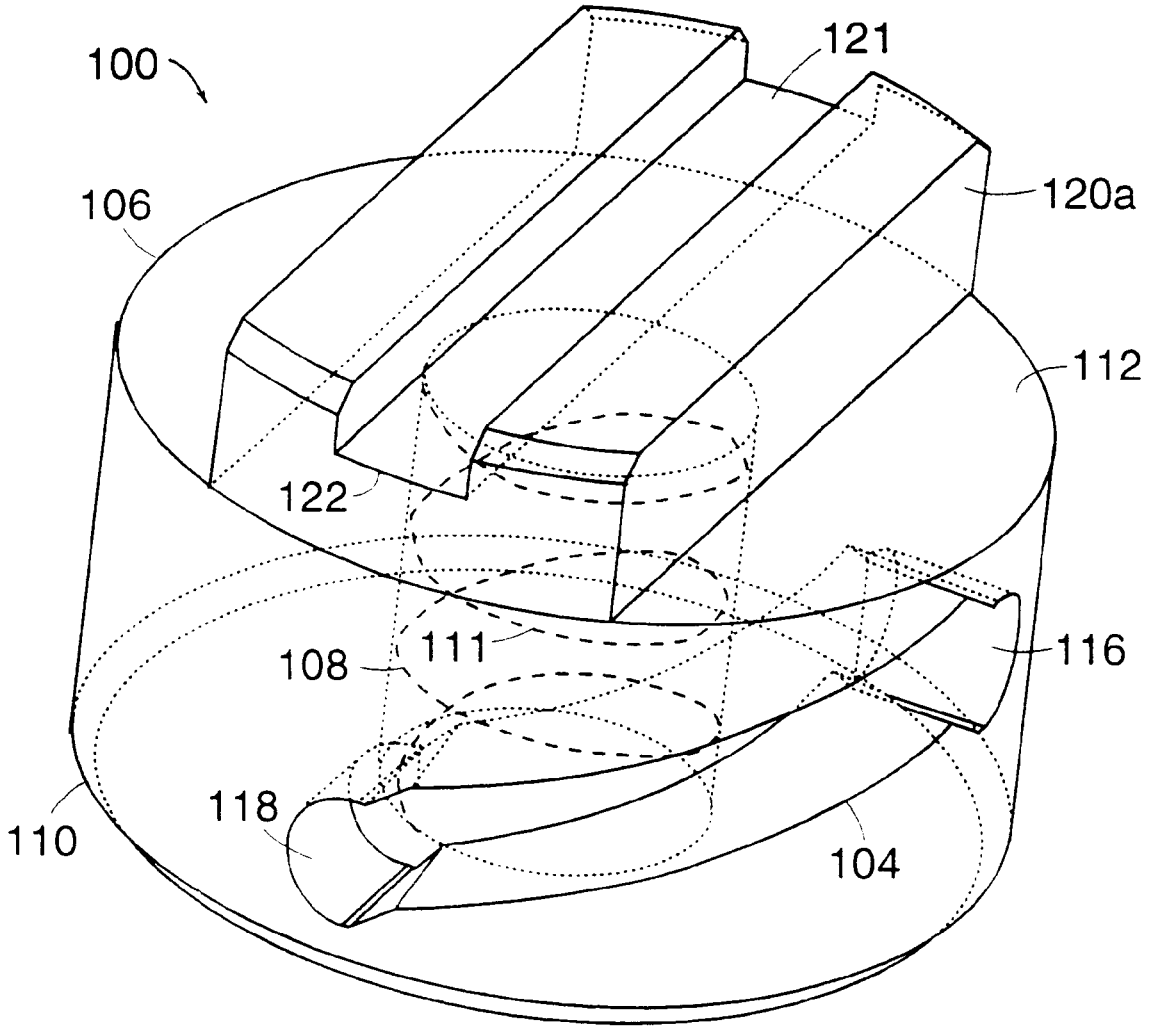
FIG. 9 is a perspective view of a registration pin of the clamp of FIG. 7.

Referring also to FIG. 9, to move pins 100 between their retracted and extended positions, pins 100 include a groove 104 that extends along approximately a quarter of the circumference of pin 100. Groove 104 is sloped with a rise to run ratio of approximately one to three. A positioning pin 113 located in a cam hole 105 defined in base 74 has a cam member 114 that extends into groove 104. A cam hole 105 is associated with each registration hole 99.

Clockwise rotation of registration pin 100 results in retraction of pin 100 into hole 99 as groove 104 rides along cam 114. Likewise, counterclockwise rotation of registration pin 100 results in pin 100 moving to its extended position. When pin 100 is turned fully clockwise 90 degrees, cam 114 sits in a dentation 116 which holds pin 100 in its retracted position. When pin 100 is turned fully counterclockwise, cam 114 sits in an indentation 118 which holds the pin in its extended position.

Pin 100 defines a central bore 108 which extends from a base 110 of the pin to below a top 112 of the pin. A spring 111 located in bore 108 biases pin 100 toward its extended position. The upward pressure exerted on the pin by the spring aids in maintaining cam 114 in indentation 116 or 118 until the user pushes down against the spring and rotates pin 100 to release the cam from the indentation.

Pins 100 include either a circular crown 120 (FIG. 7) or a racetrack crown 120*a* (FIG. 9). Crowns 120, 120*a* each define a slot 121 for receiving a screwdriver to rotate the pin. Circular crown 120 locates registration hole 28A of printing plate 24 in both the lateral and longitudinal directions, i.e., in the direction of the length of plate 24 and in the direction of width of plate 24. Racetrack crown 120*a* locates registration hole 120*b* in only in one direction, i.e., along the length of plate 24 but not along the width of plate 24. The combination of the circular and rectangular crowned pins insures that plate 24 is supported (kinematically restrained) in both the lateral and longitudinal directions while allowing enough play along the width of plate 24 to prevent warping.

Other embodiments are within the scope of the following claims.

Figure 11:
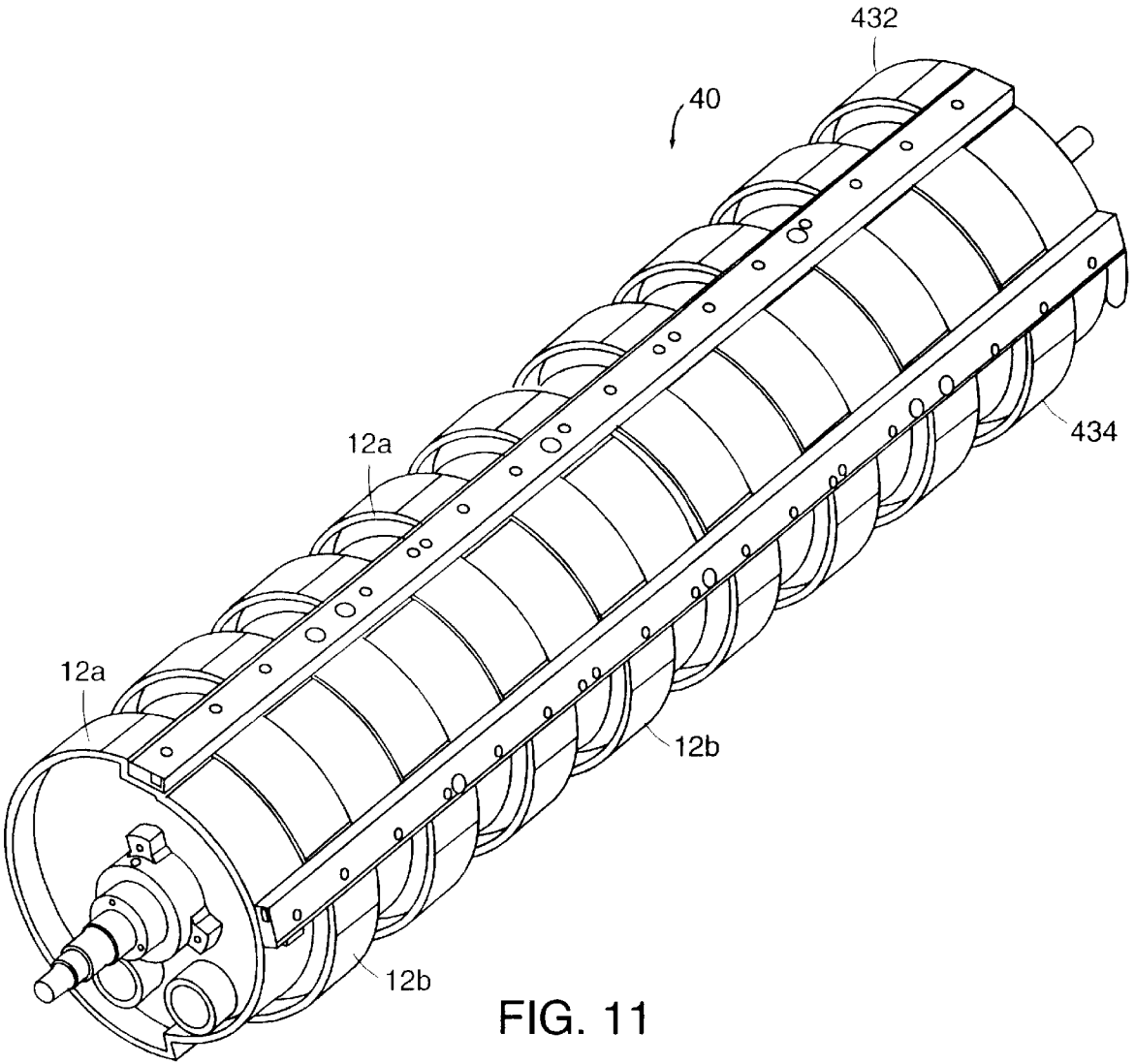
FIG. 11 is a perspective view of an alternative embodiment of a printing drum assembly.

For example, leading edge assembly 32 and trailing edge assembly 34 can include a greater or less number of disks. Referring to FIG. 11, a drum assembly 410 having nine disks 412*a* for the leading edge assembly 432 and eight disks 412*b* for the trailing edge assembly 434 are particularly advantageous for mounting of the various size printing plates to the drum.

In addition to the standard registration pins 100, which typically measure 10 mm across, the leading edge clamp can include a smaller set of pins that measure 6 mm across. These smaller pins 100 support a plate having smaller registration holes punched into the leading edge. The smaller configuration allows registration holes to be punched into sheets having perforations along the leading edges without interfering with the perforations.

The clamp includes several registration pin configurations to accommodate different size plates. For example, 10 mm pins having 220 mm spacing 400 mm spacing and 425 mm spacings, and 6 mm pins having a 220 mm spacing can be are incorporated. The pins are preferably made of stainless steel.

Figure 12:
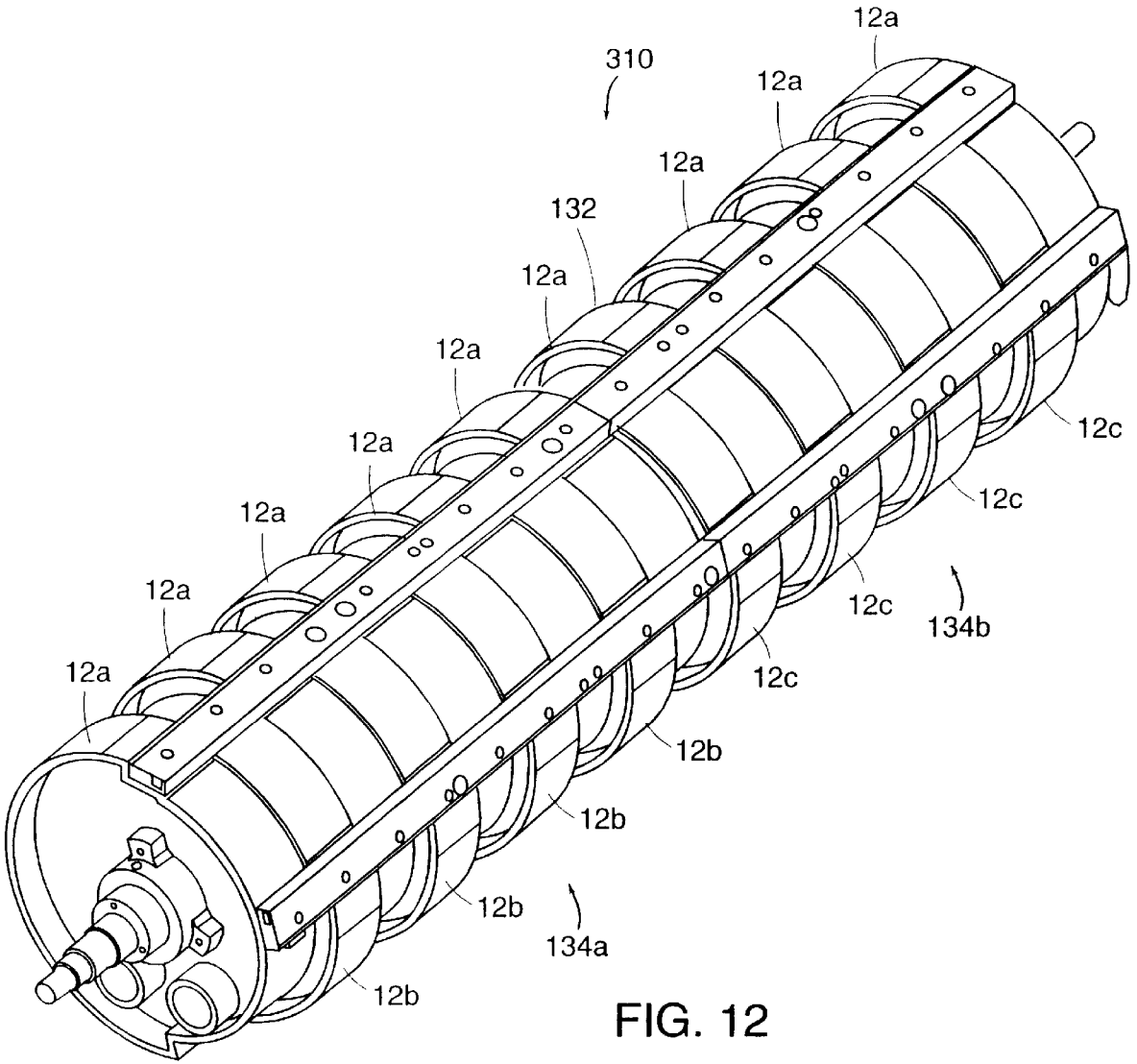
FIG. 12 is a perspective view of an additional alternative embodiment of a printing drum assembly.
Figure 1:
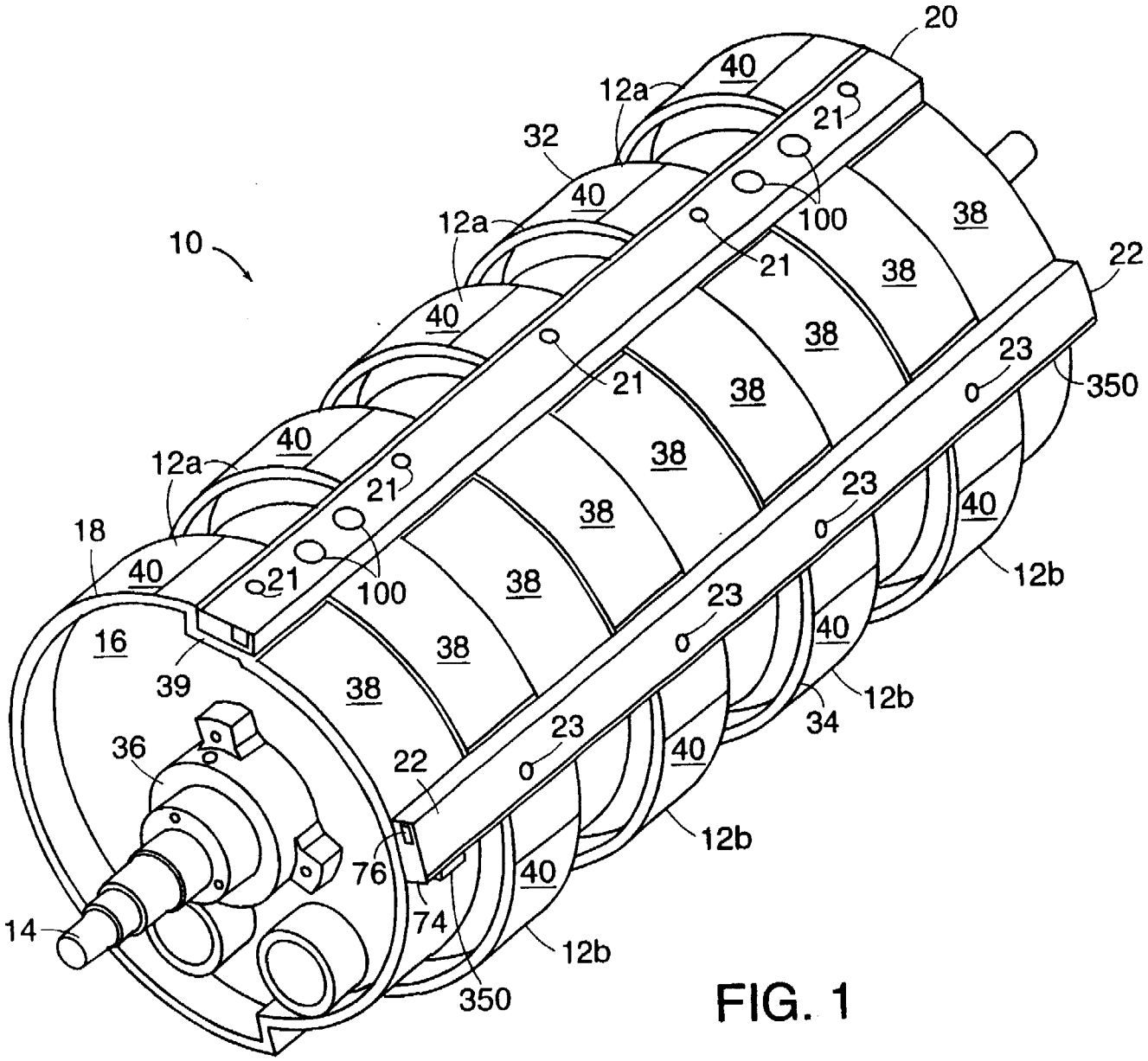
Figure 2A:
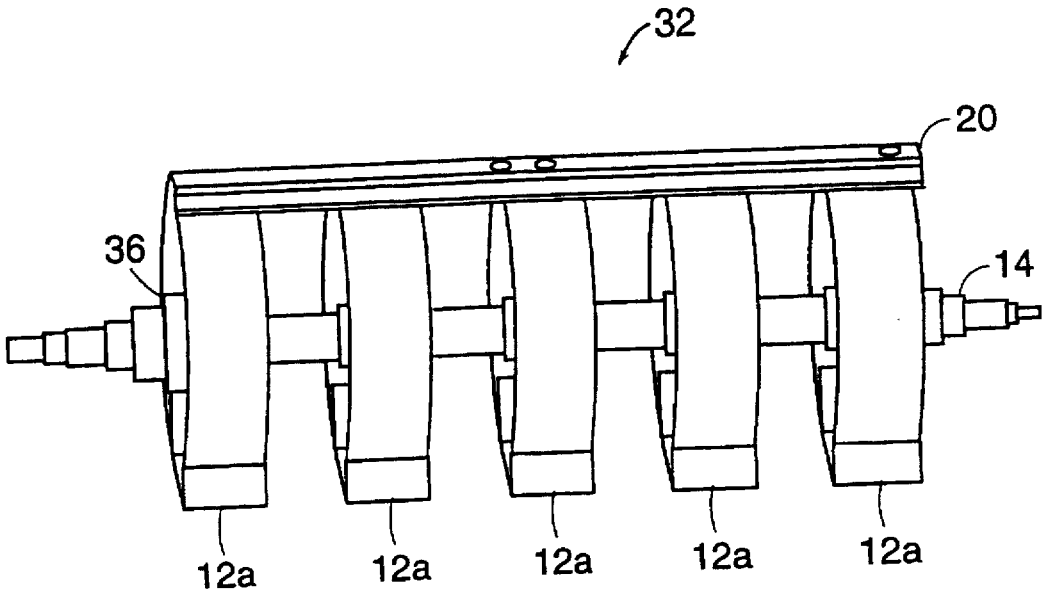
Figure 2B:
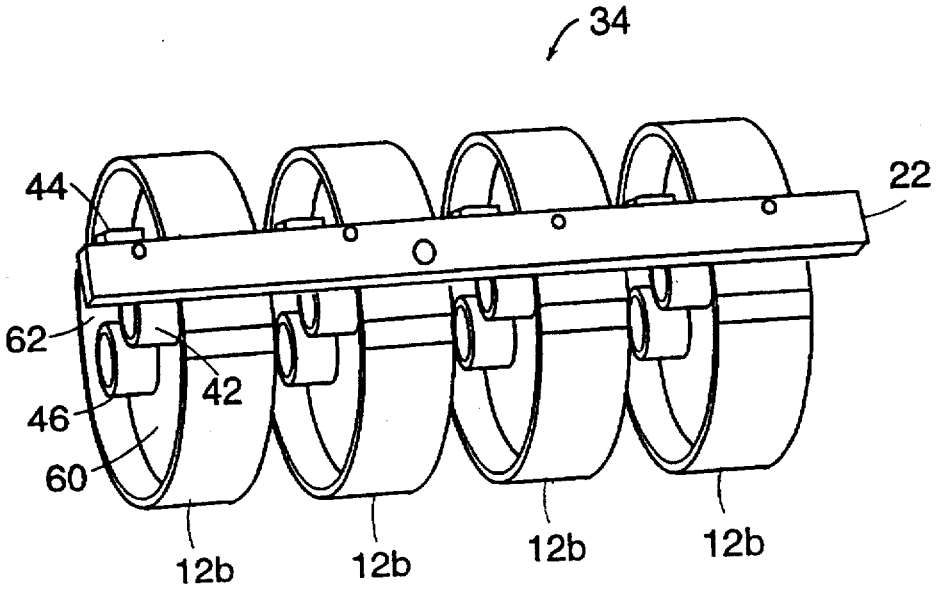
Figure 3B:
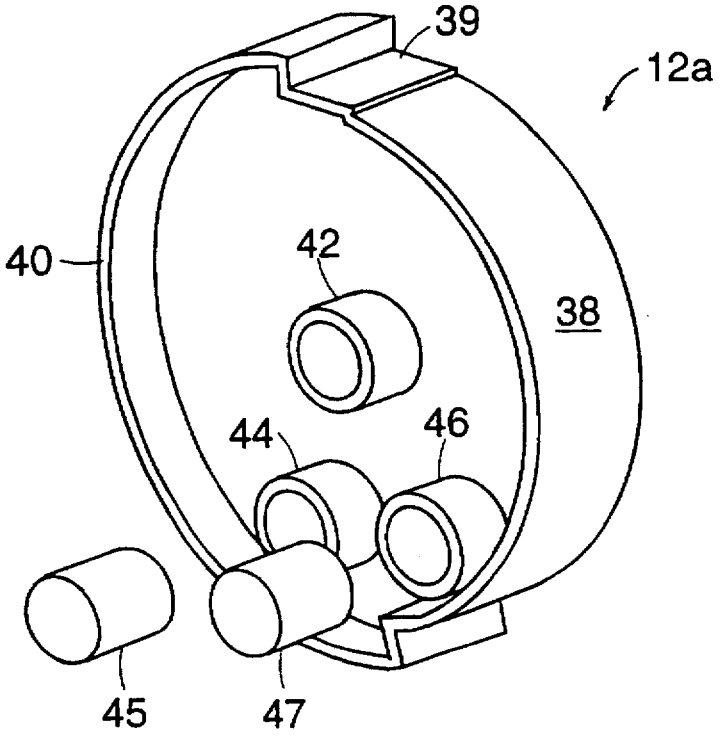
Figures 3A, 4, 5:
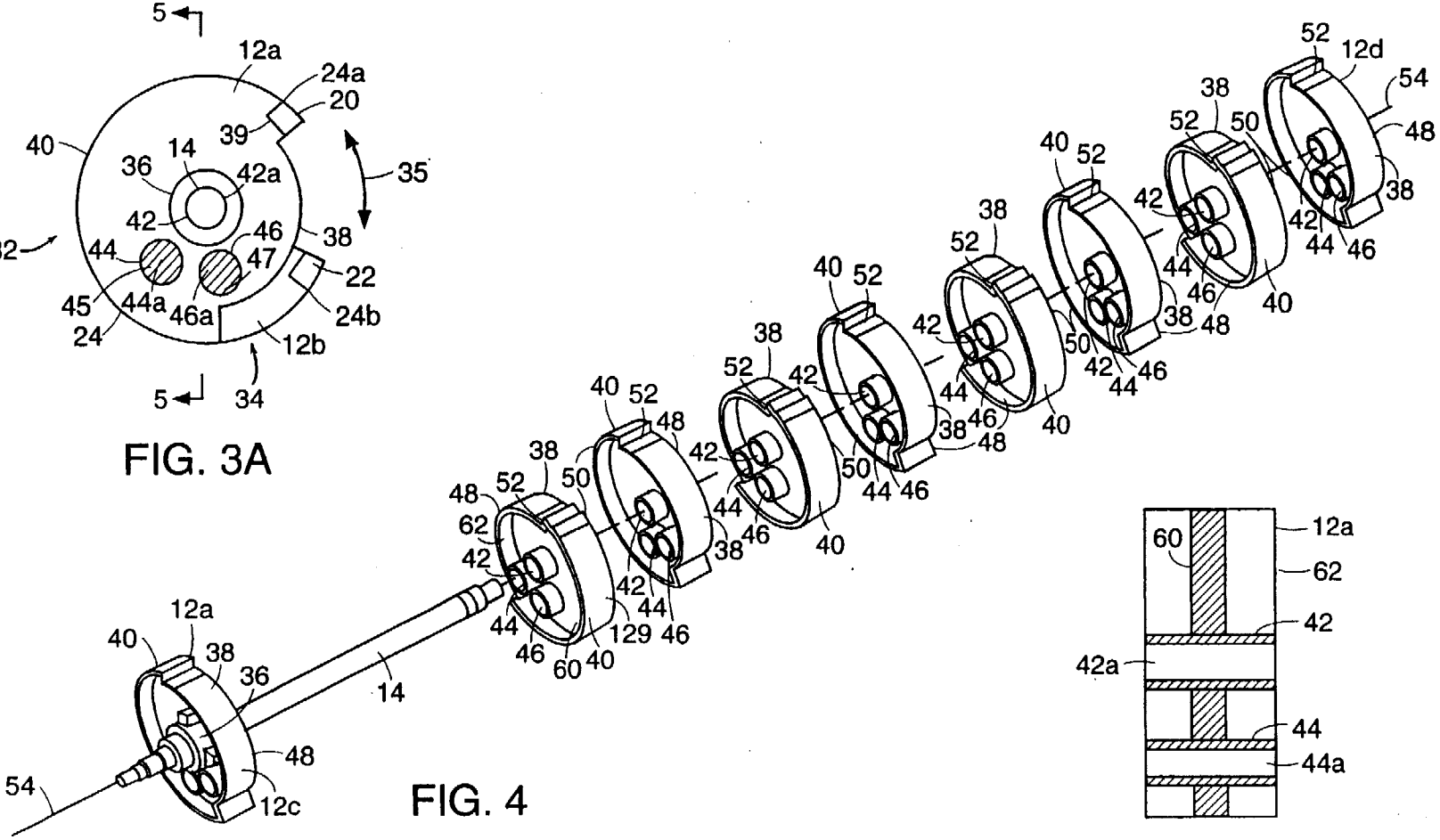
Figure 6B:
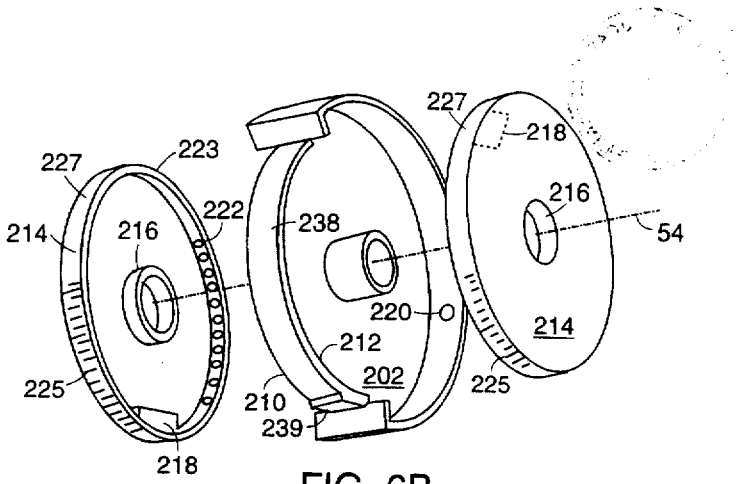
Figure 6A:
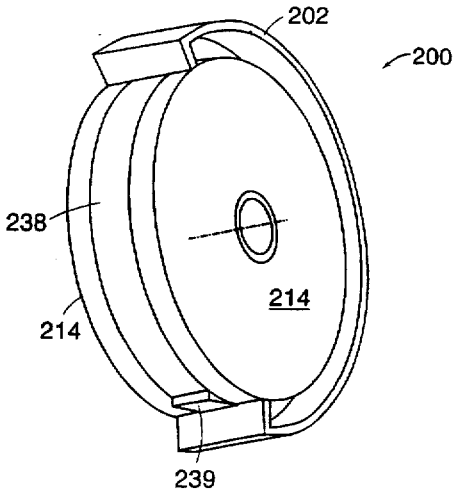
Figure 7B:
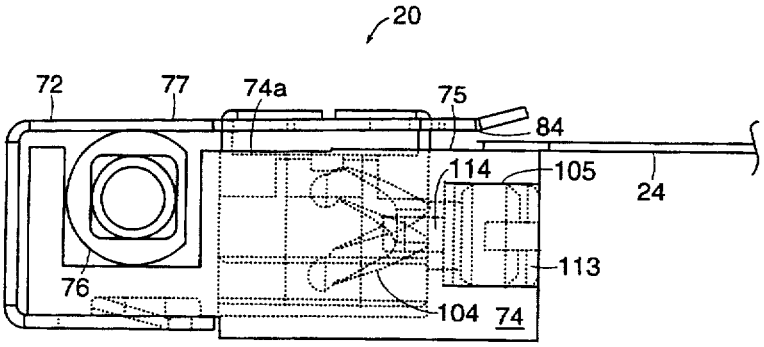
Figure 7A:
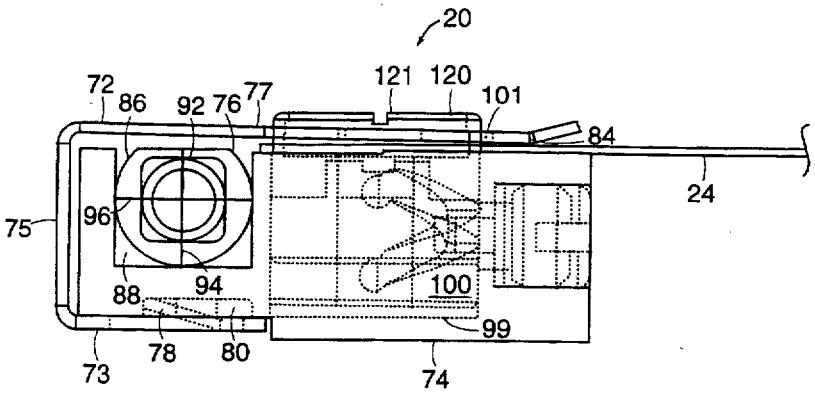
Figure 8:
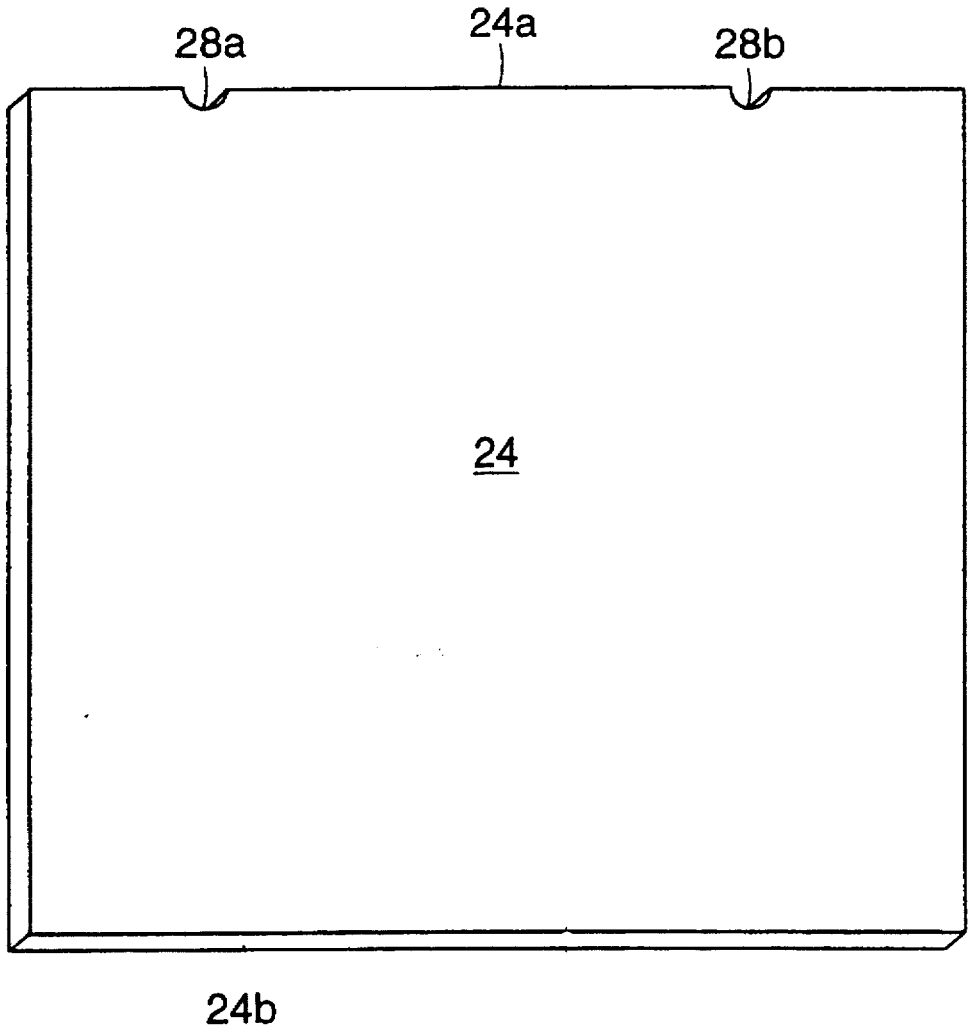
Figure 9:
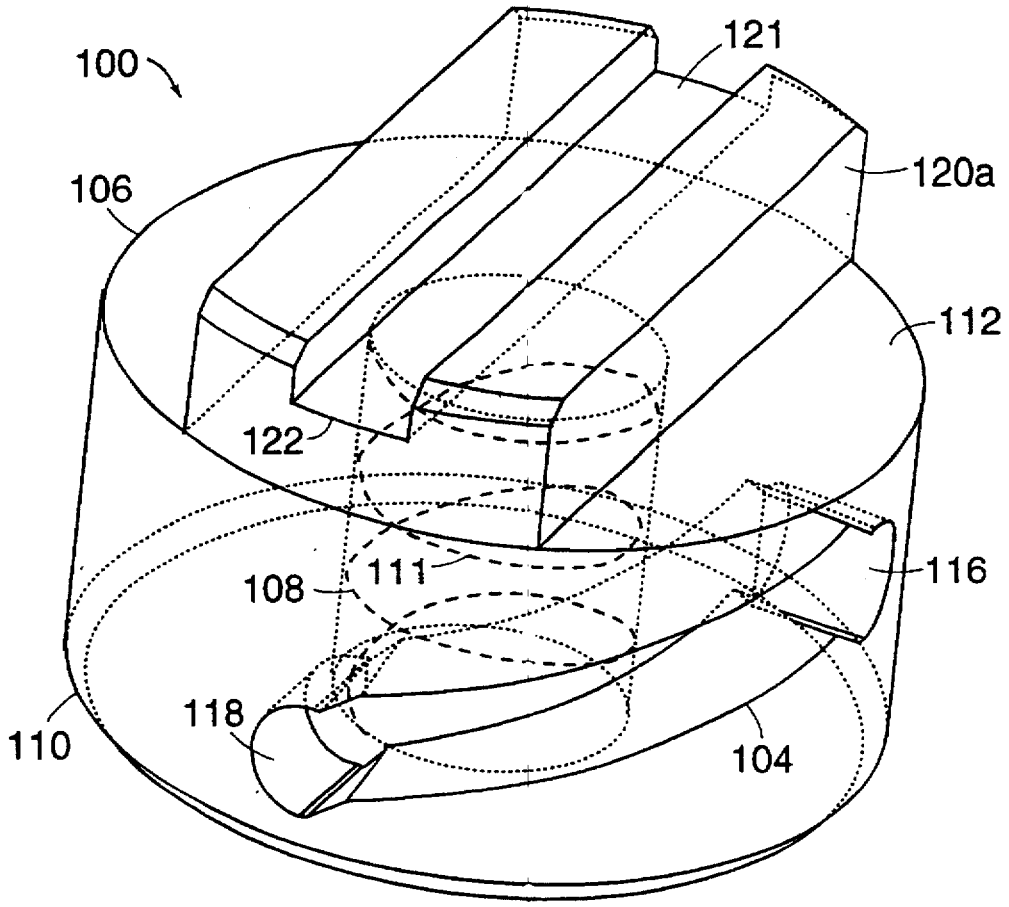
Figure 10A:
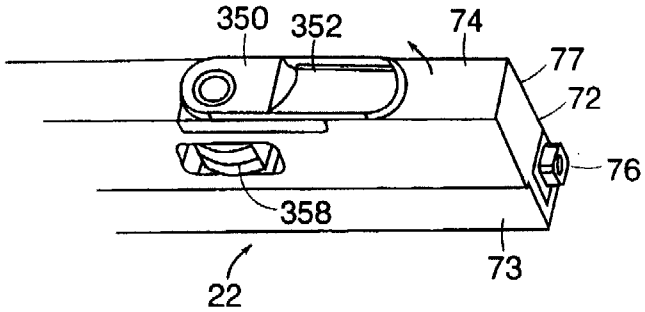
Figure 10B:
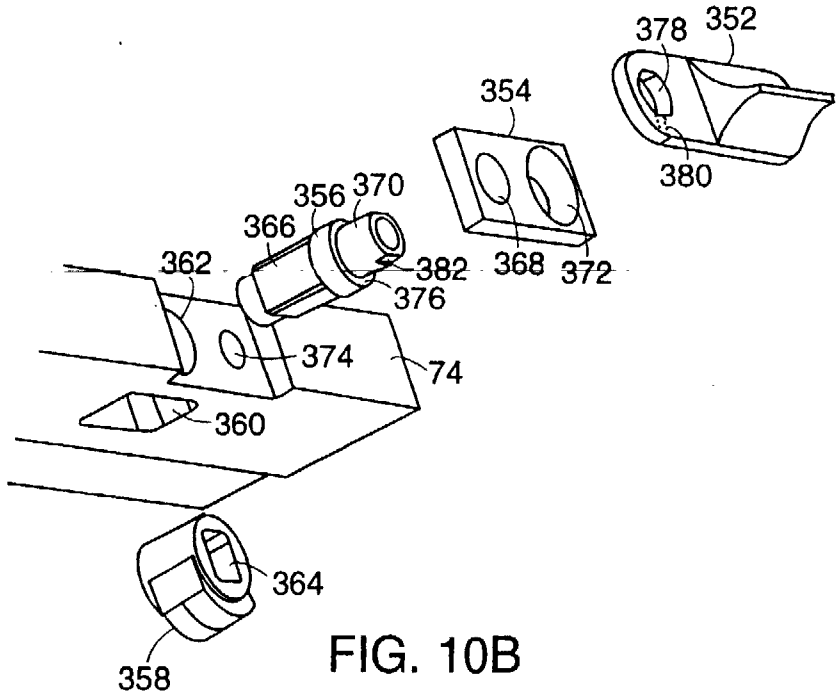
Figure 11:
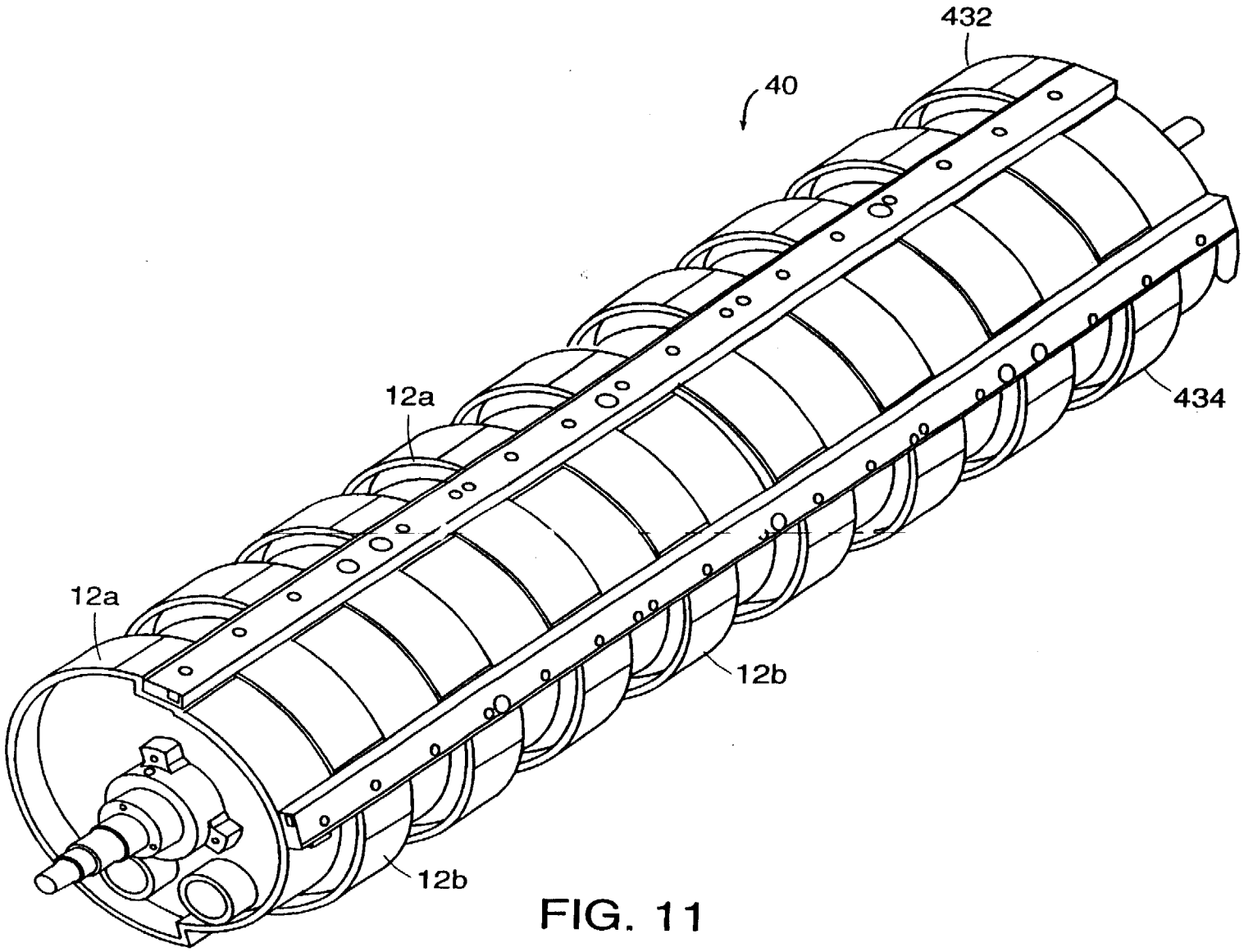
Figure 12:
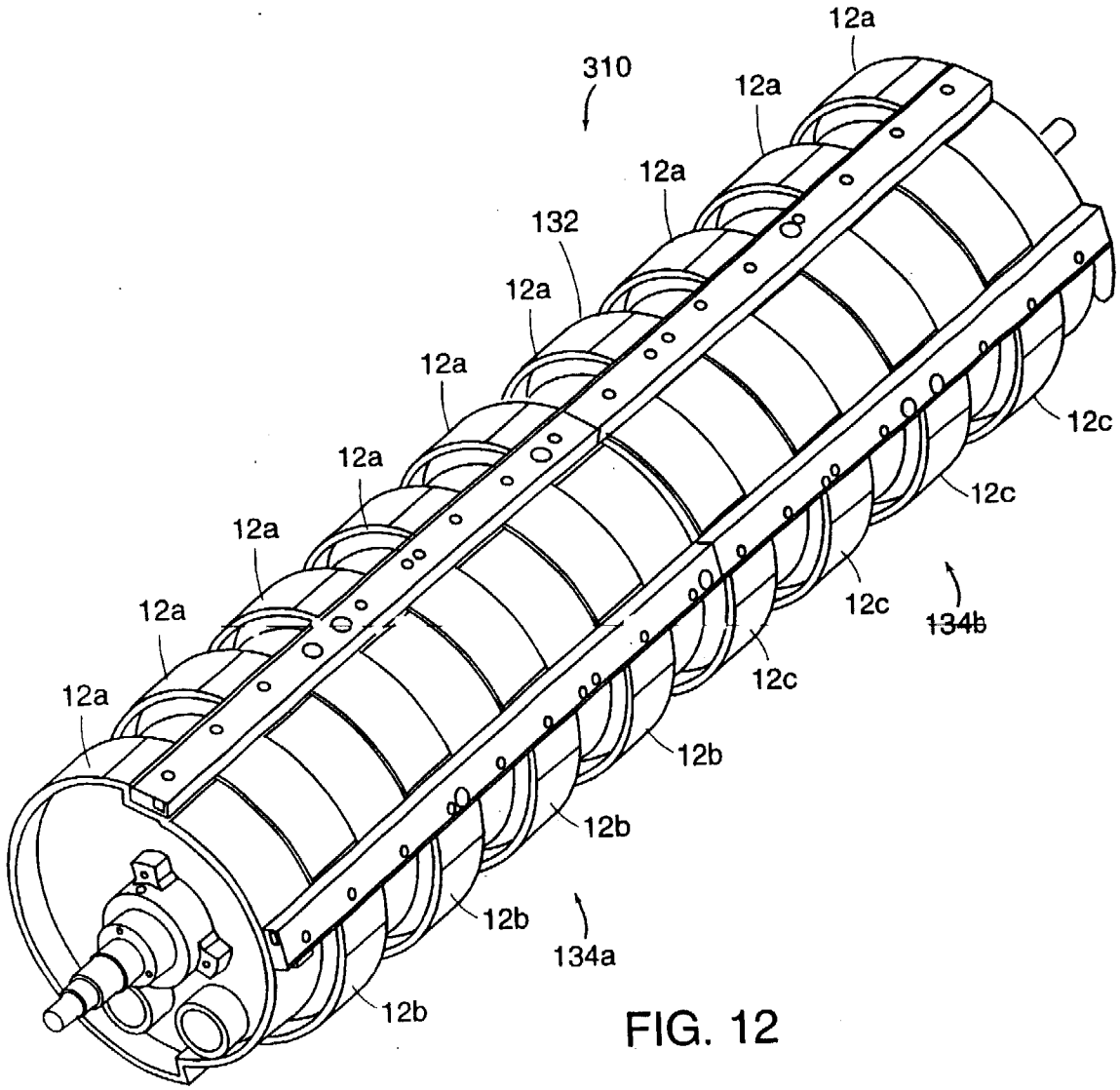
Figure 1:
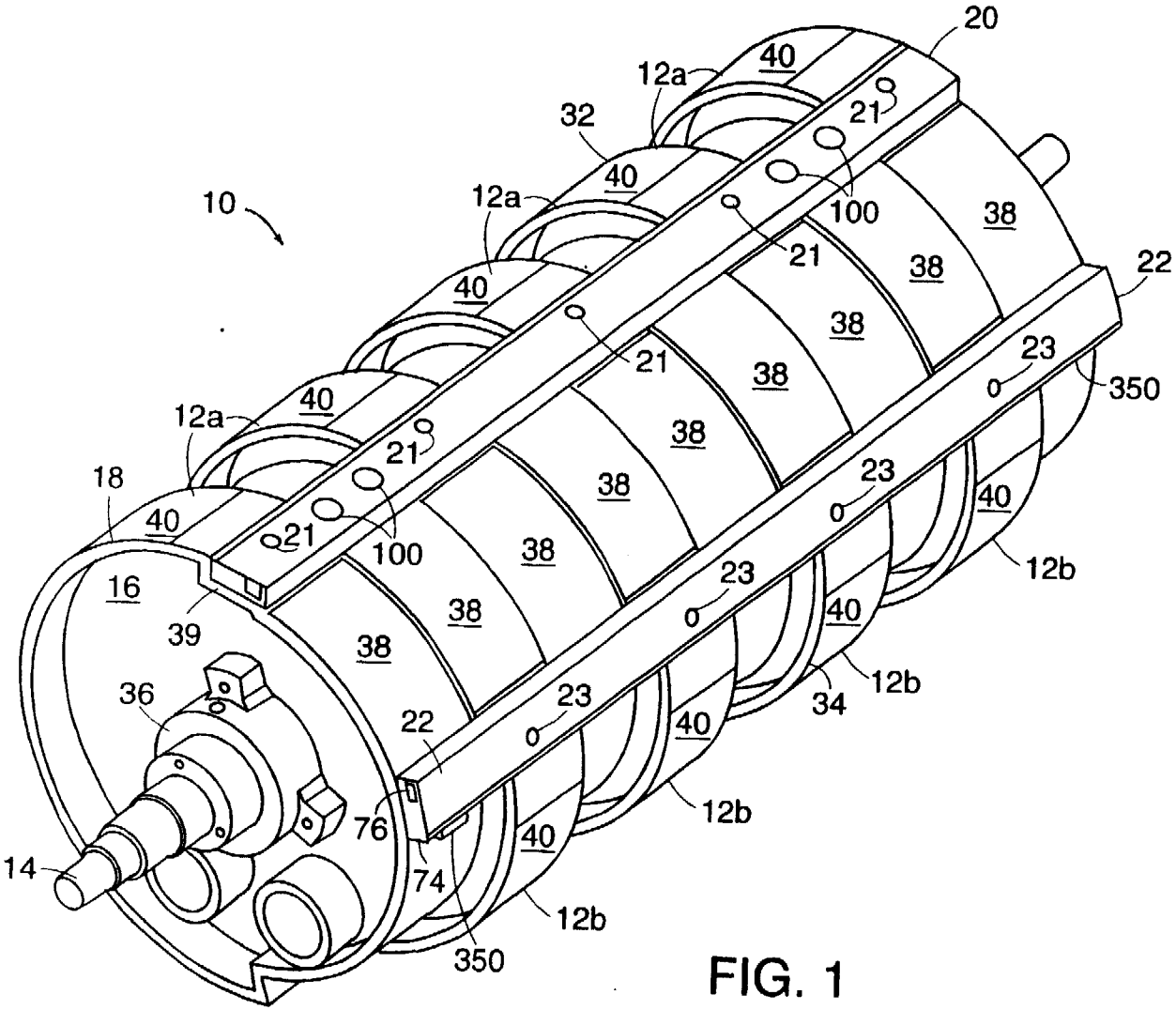
Figure 2A:
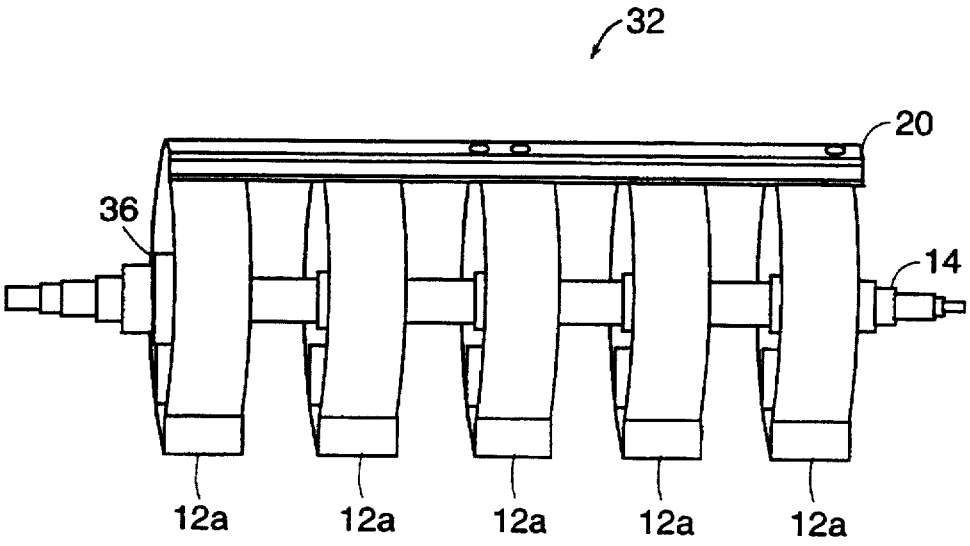
Figure 2B:
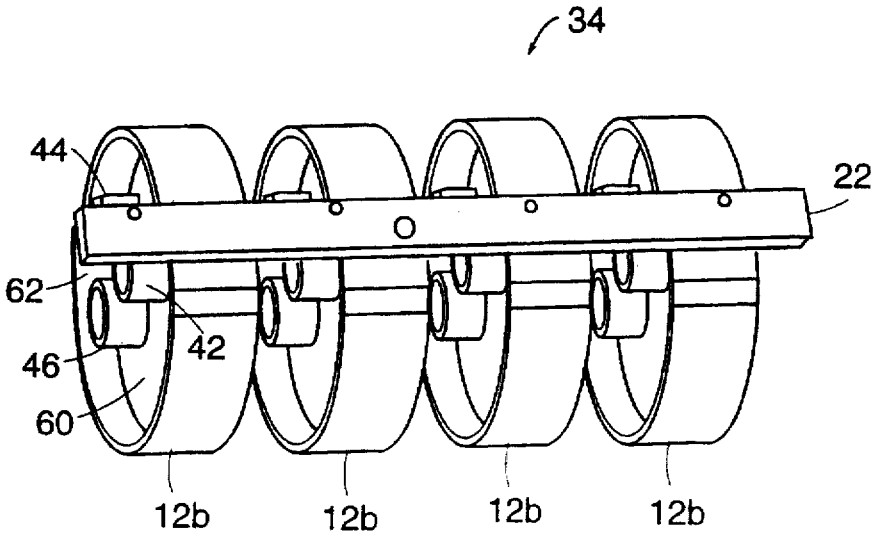
Figures 3A, 4, 5:
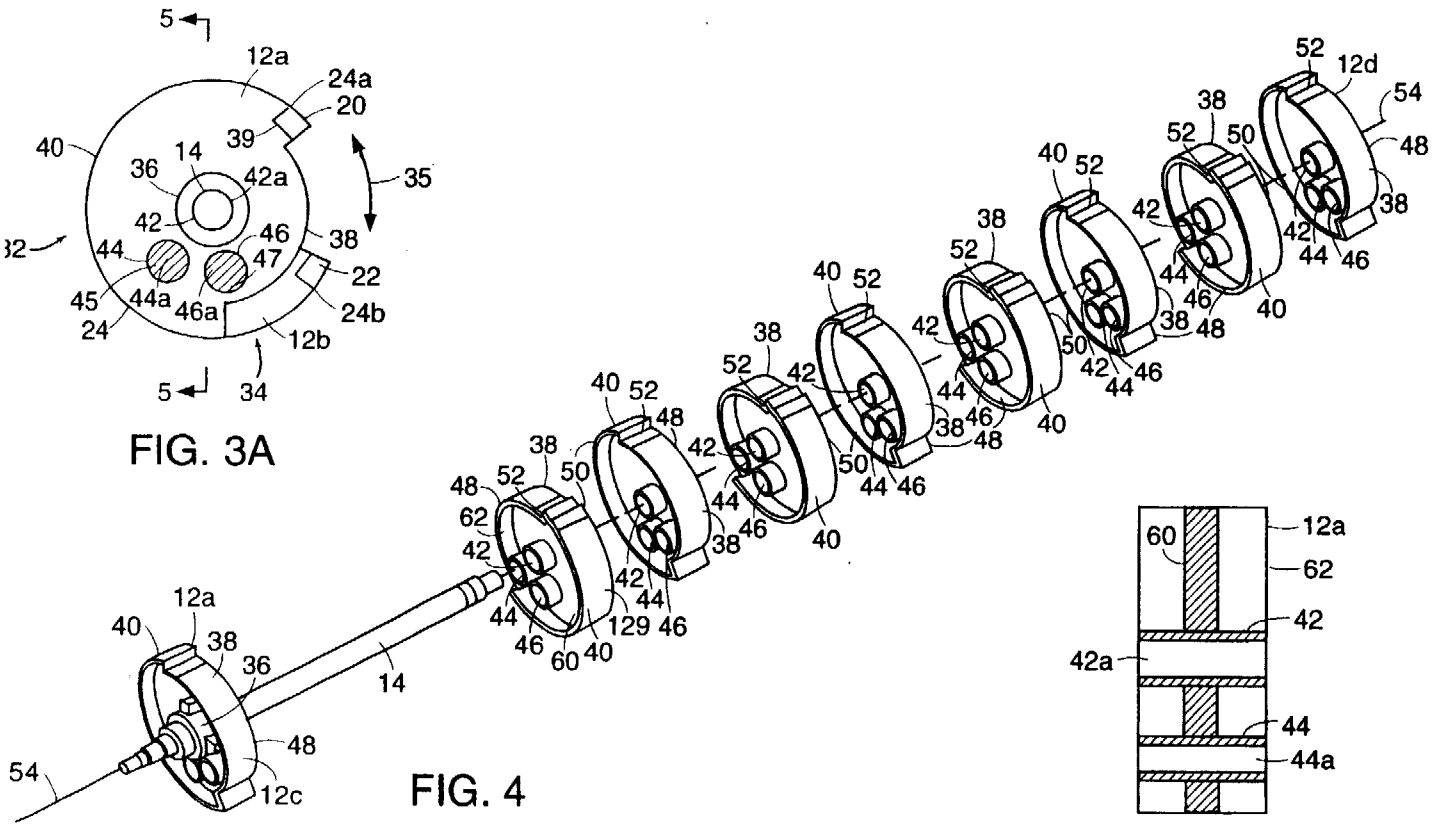
Figure 3B:
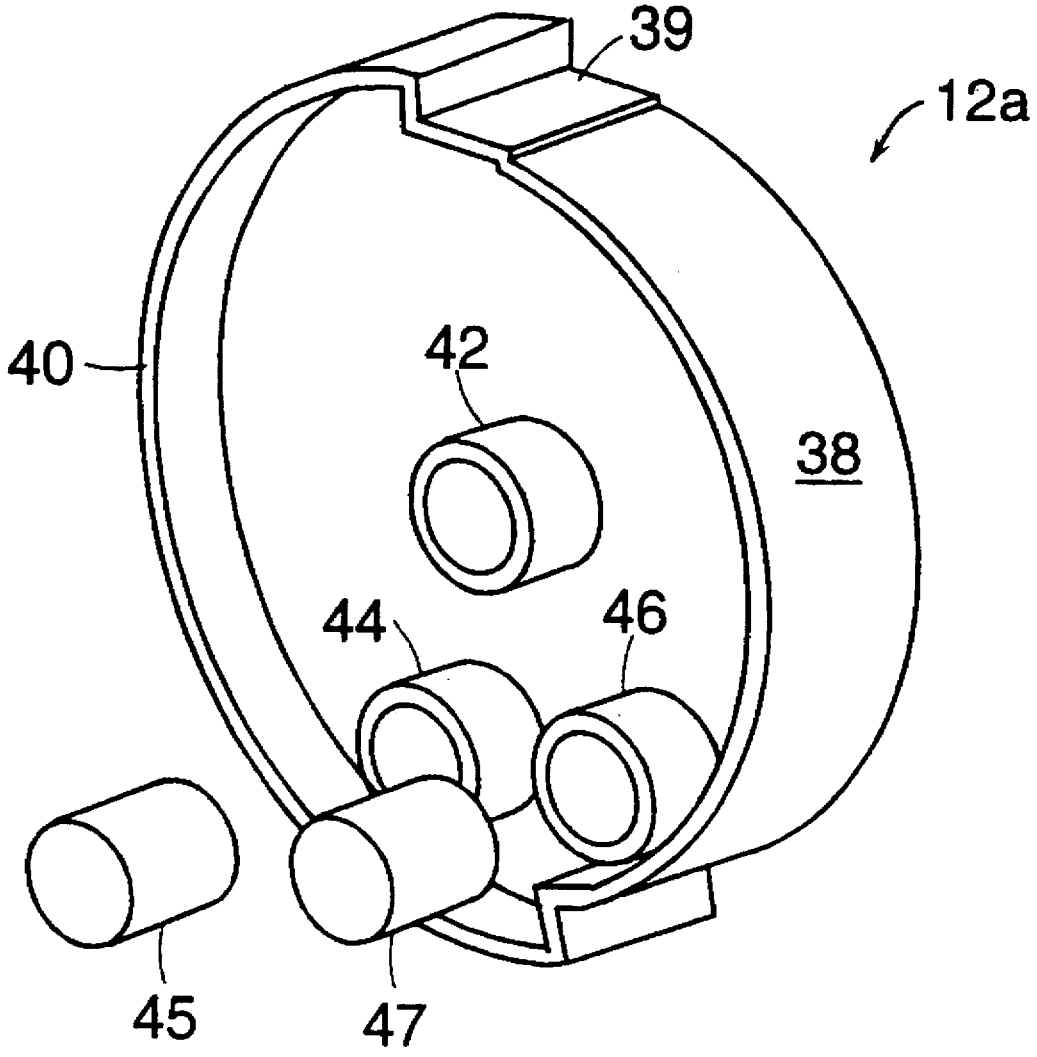
Figure 6B:
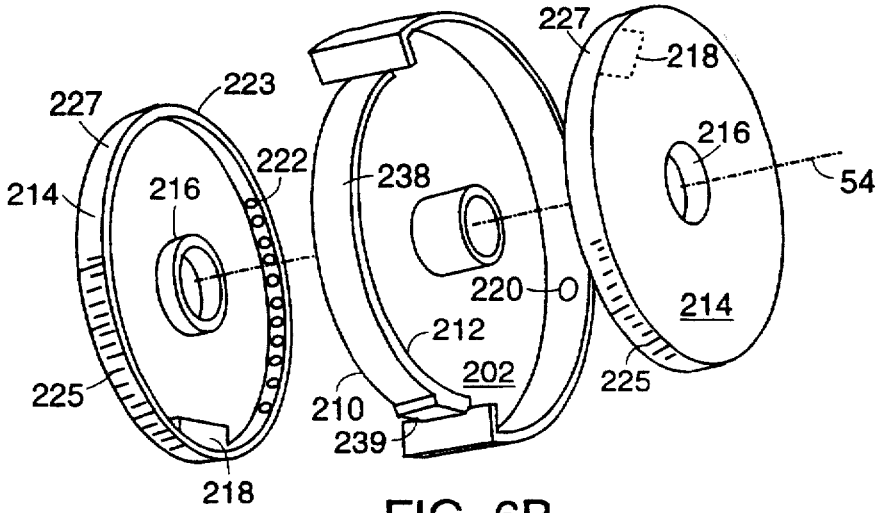
Figure 6A:
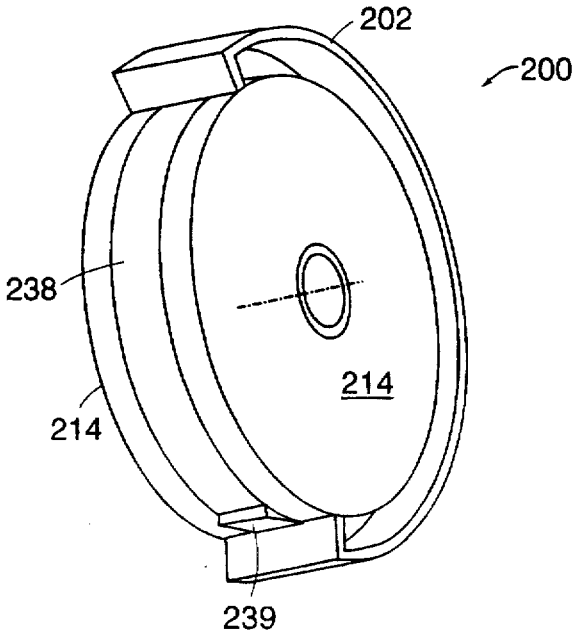
Figure 7B:
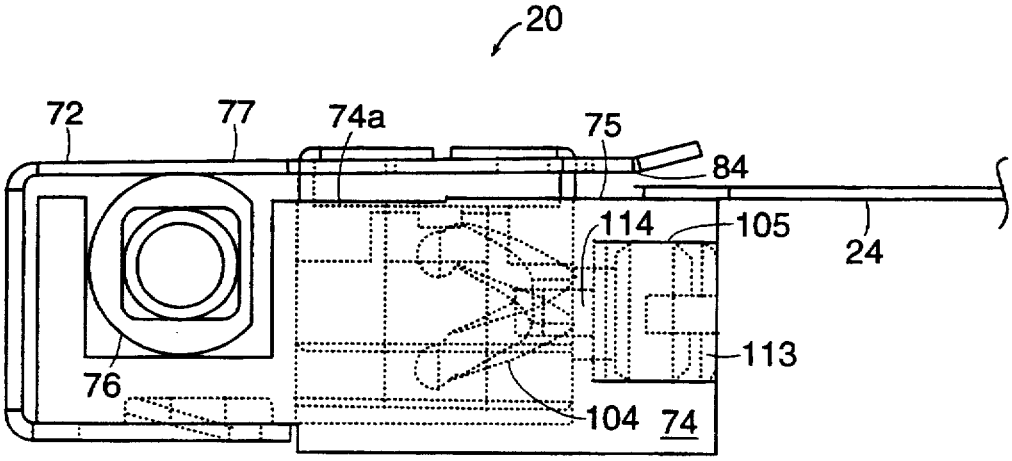
Figure 7A:
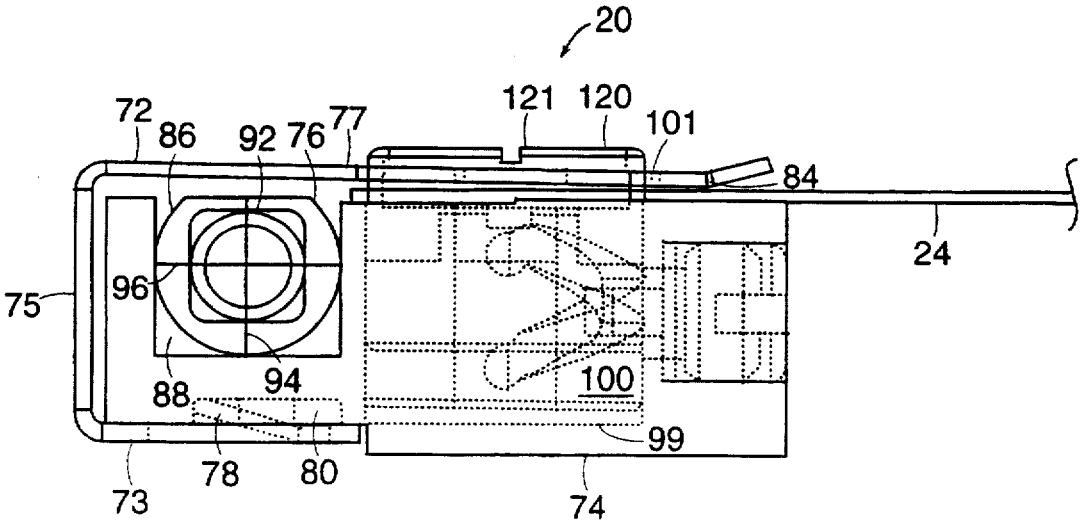
Figure 8:
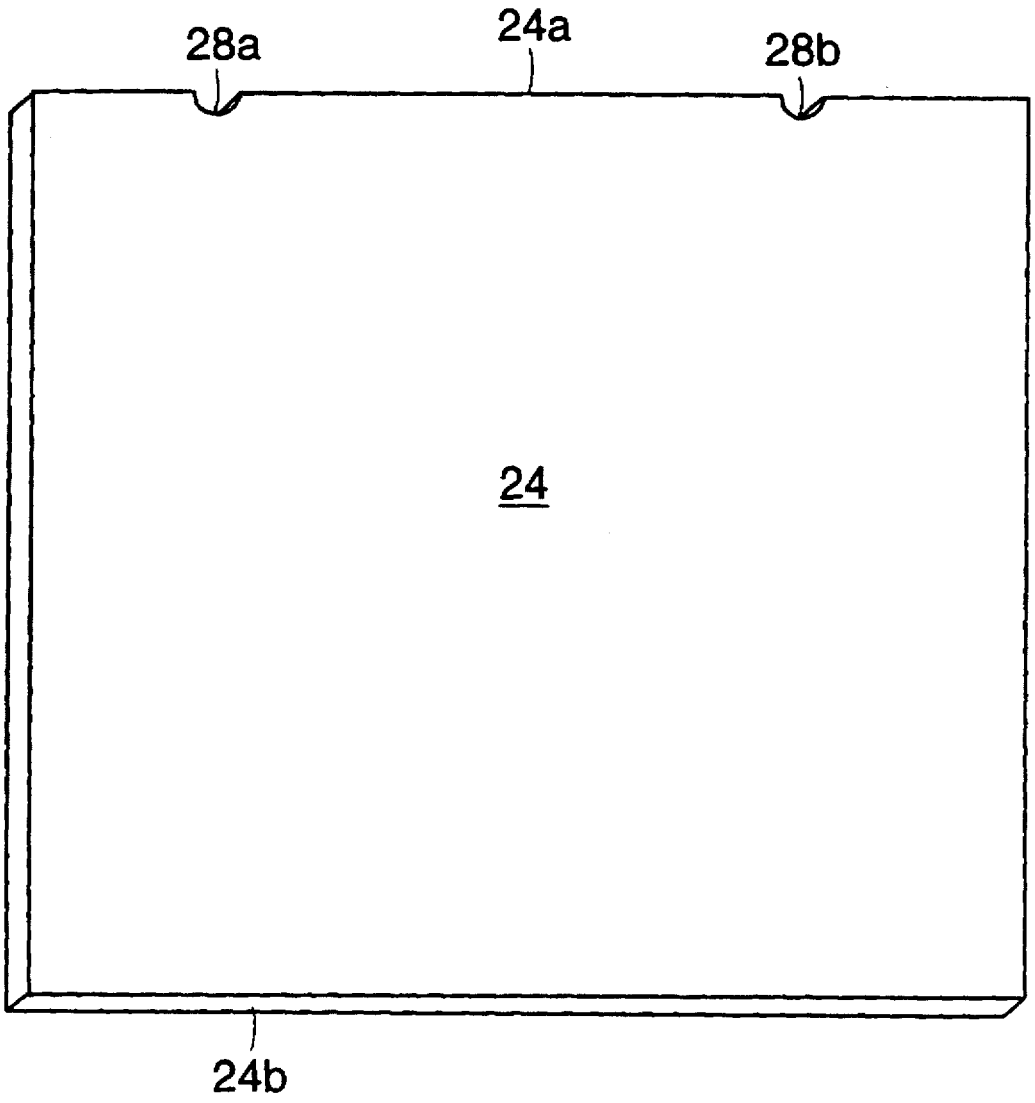
Figure 9:
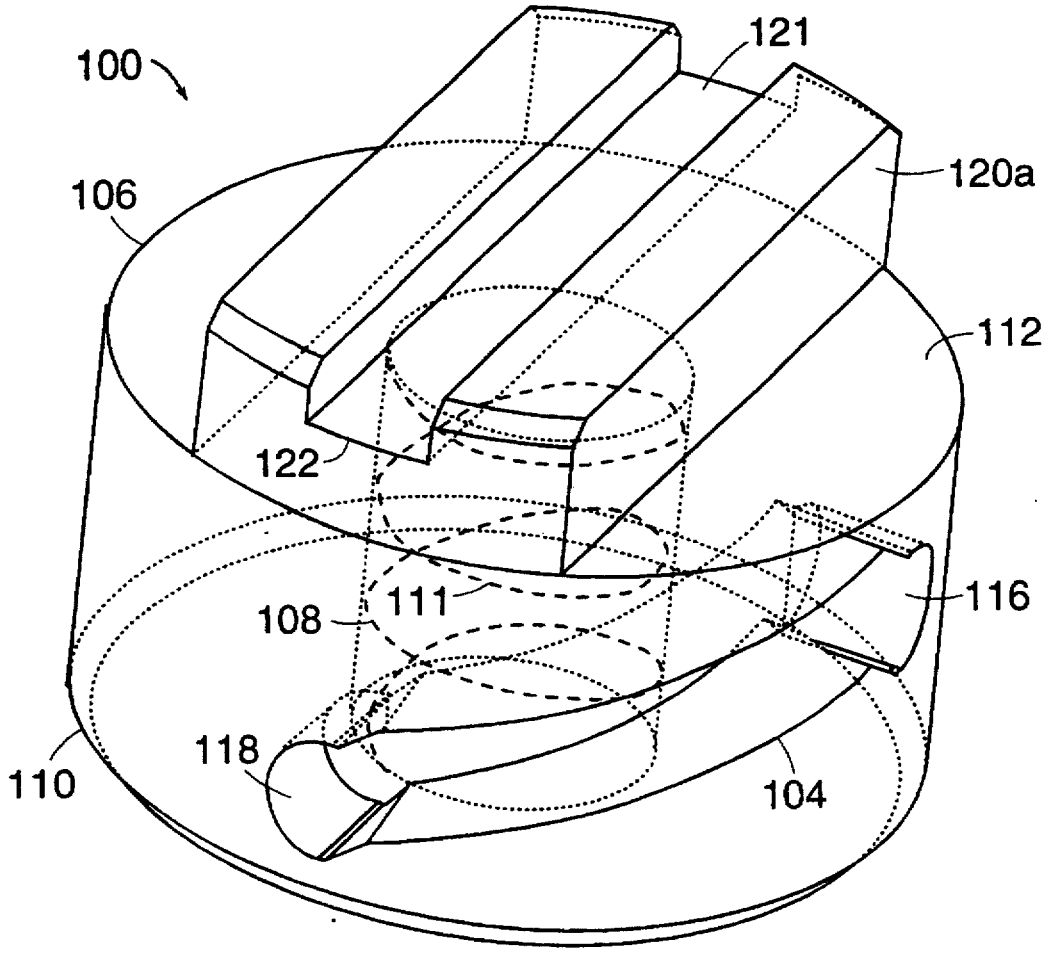
Figure 10B:
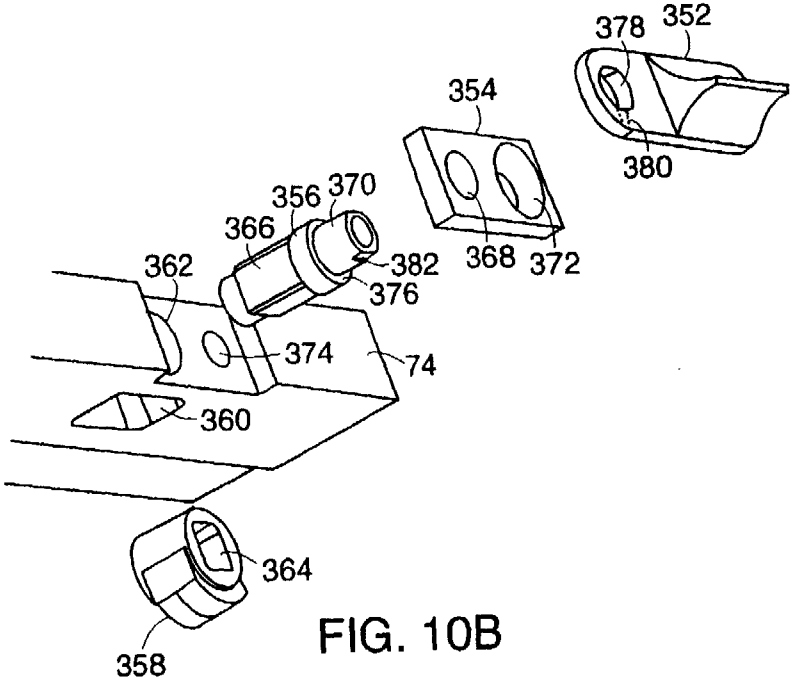
Figure 10A:
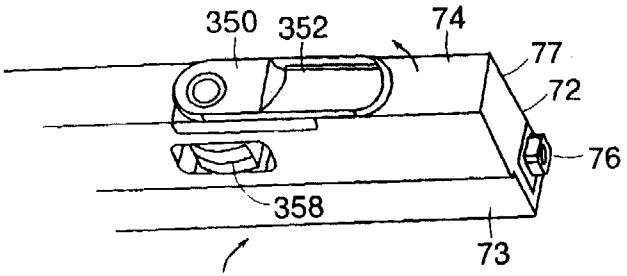
Figure 11:
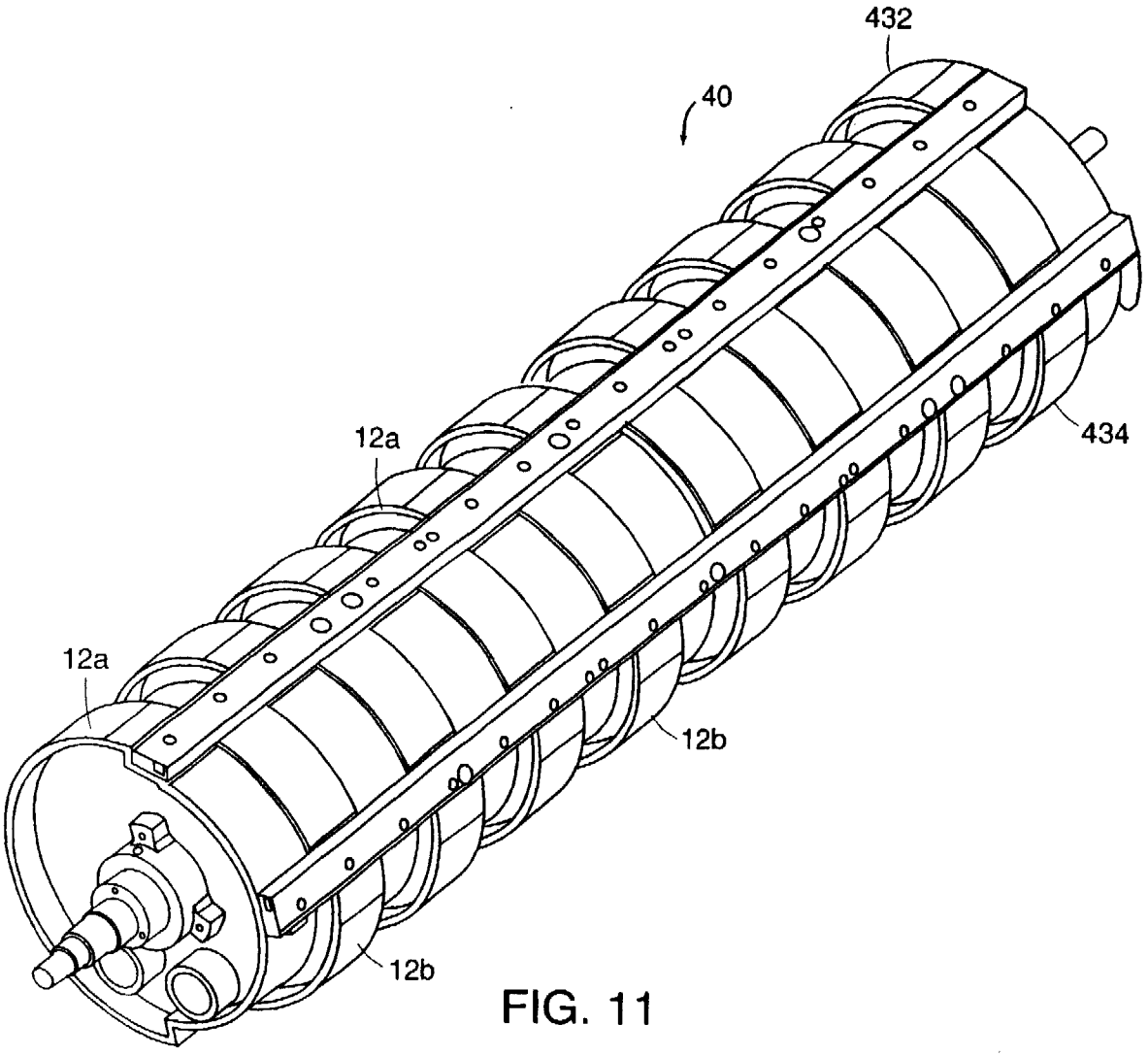
Figure 12:
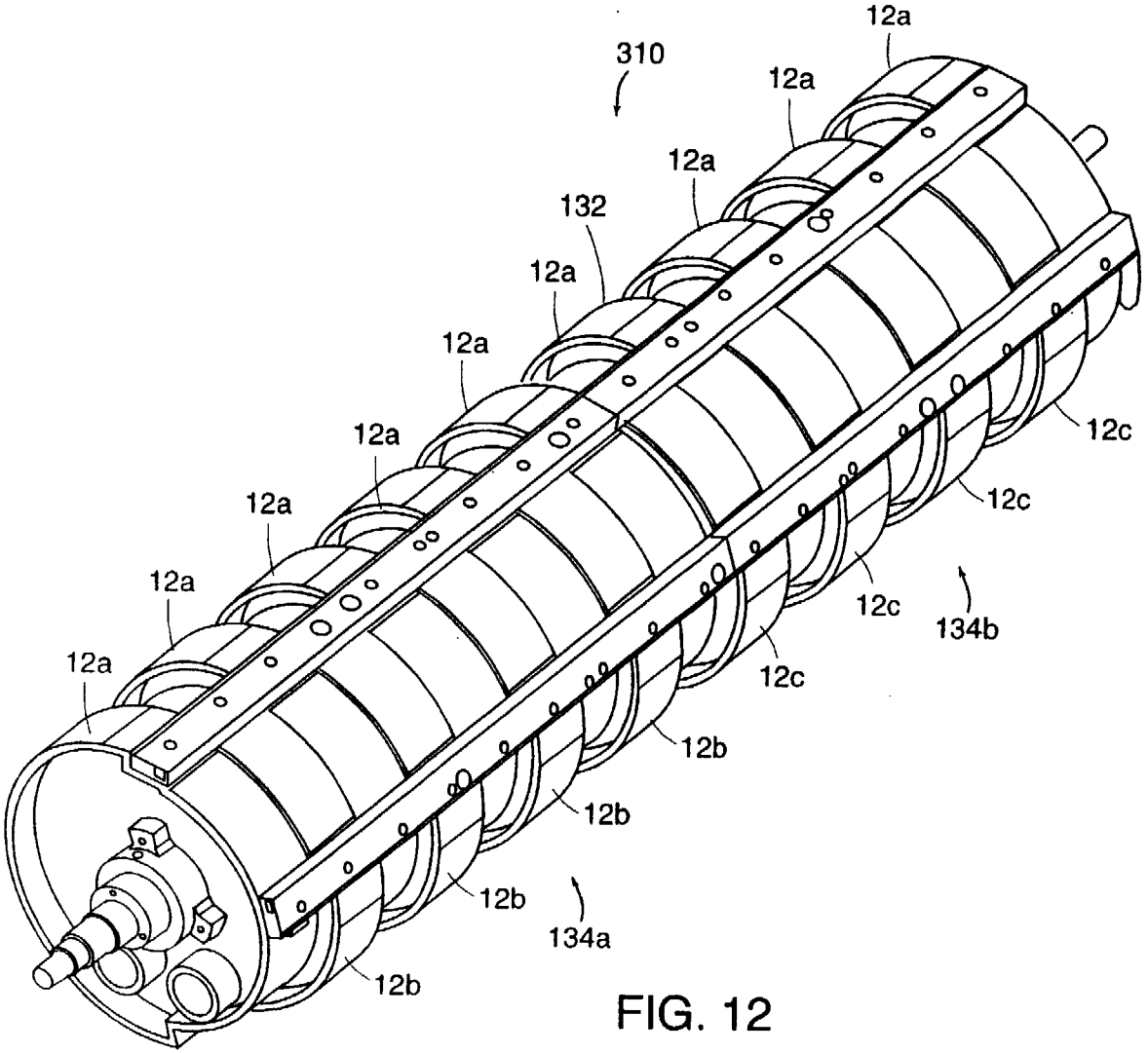

Referring to FIG. 12, a drum assembly 310 includes a leading edge assembly 132 with nine disks 12*a*, a first trailing edge assembly 134*a* with four disks 12*b*, and a second trailing edge assembly 134*b* with four disks 12*c*. Two trailing edge assemblies are independently rotatable with respect to leading edge assembly 132 such that two plates 24 of different lengths can be mounted to drum assembly 310. Up to, e.g., two twelve inch wide plates can be mounted to drum assembly 310.

What is claimed is:

1. A printer drum having an axis of rotation, comprising:

a leading edge assembly for holding a first end of a substrate, the leading edge assembly including a leading edge clamp and a first plurality of interconnected disks, and a trailing edge assembly for holding a second end of; the substrate, the trailing edge assembly including a trailing edge clamp and a second plurality of interconnected disks, the second plurality of disks being interleaved with the first plurality of disks and rotatable relative to the first plurality of disks about the axis of rotation, the leading edge clamp and the trailing edge clamp being configured to hold the substrate during rotation of the printer drum for printing on the substrate.

2. The printer drum of claim 1 wherein the axis of rotation is a common central axis of the disks of the first plurality and the disks of the second plurality.

3. The printer drum of claim 2 wherein each disk defines a centric hole and further comprising an axle extending along the axis of rotation and through each centric hole.

4. The printer drum of claim 3 wherein the axle is fixedly connected to the leading edge assembly such that rotation of the axle causes rotation of the leading edge assembly.

5. The printer drum of claim 1 further including a rotation lock for preventing the disks of the trailing edge assembly from rotating with respect to the disks of the leading edge assembly.

6. The printer drum of claim 1 wherein the disks of the first plurality and the disks of the second plurality each define a through hole located between a center of the disk and a circumference of the disk for containing a balancing weight.

7. The printer drum of claim 6 further including a balance weight located in each disk through hole such that a center of mass of the leading edge assembly and a center of mass of the trailing edge assembly lie along the axis of rotation.

8. The printer drum of claim 1 further including a balancing disk interleaved with the disks of the first plurality and the disks of the second plurality, the balancing disk including an adjustably positioned balancing weight for compensating for the weight of a printing plate attached to the printer drum.

9. The printer drum of claim 8 wherein the balancing disk comprises a disk of the leading edge assembly.

10. The printer drum of claim 8 wherein the balancing disk includes a central member having a first side and an opposing second side, a first ring rotatably mounted to the first side of the central member, and a second ring rotatably mounted to the second side of the central member.

11. The printer drum of claim 10 wherein the balancing weight comprises a first weight fixedly mounted to the first ring and a second weight fixedly mounted to the second ring.

12. The printer drum of claim 1 wherein the leading edge clamp interconnects the first plurality of disks and the trailing edge clamp interconnects the second plurality of disks.

13. The printer drum of claim 12 wherein the disks of the first plurality and the disks of the second plurality are generally circular in shape and each disk defines a relieved section along a portion of a circumference of the disk, the relieved section of each disk providing clearance for the leading edge clamp and the trailing edge clamp during rotation of the leading edge clamp relative to the trailing edge clamp.

14. The printer drum of claim 12 wherein the disks of the first plurality and the disks of the second plurality define a continuous substrate support surface.

15. The printer drum of claim 1 wherein the disks of the first plurality and the disks of the second plurality are substantially identical, each disk of the first plurality of disks and the second plurality of disks having a first side and an opposing second side, when interleaved the disks of the second plurality are reversed with respect to the disks of the first plurality such that the first side of a disk of the first plurality faces the first side of a disk of the second plurality.

16. The printer drum of claim 1 wherein the leading edge assembly includes a third plurality of disks and further comprising a second trailing edge assembly including a fourth plurality of disks, the fourth plurality of disks being interleaved with the third plurality of disks and rotatable relative to the leading edge assembly about the axis of rotation.

17. The printer drum of claim 1 wherein the leading edge clamp includes a prestressed clamping member for applying a clamping force to the substrate to hold the substrate.

18. The printer drum of claim 17 further comprising an actuator for releasing the clamping force.

19. The printer drum of claim 1 wherein the trailing edge clamp includes a prestressed clamping member for applying a clamping force to the substrate to hold the substrate.

20. The printer drum of claim 19 further comprising an actuator for releasing the clamping force.

21. A printer drum having an axis of rotation, comprising:

a leading edge assembly for holding a first end of a substrate, the leading edge assembly including a first plurality of interconnected disks, and a trailing edge assembly for holding a second end of the substrate, the trailing edge assembly including a second plurality of interconnected disks, the second plurality of disks being interleaved with the first plurality of disks and rotatable relative to the first plurality of disks about the axis of rotation, wherein the disks of the first plurality and the disks of the second plurality each define a through hole located between a center of the disk and a circumference of the disk for containing a balancing weight.

22. The printer drum of claim 21 further including a balance weight located in each disk through hole such that a center of mass of the leading edge assembly and a center of mass of the trailing edge assembly lie along the axis of rotation.

23. A printer drum having an axis of rotation, comprising:

a leading edge assembly for holding a first end of a substrate, the leading edge assembly including a first plurality of interconnected disks, a trailing edge assembly for holding a second end of the substrate, the trailing edge assembly including a second plurality of interconnected disks, the second plurality of disks being interleaved with the first plurality of disks and rotatable relative to the first plurality of disks about the axis of rotation, and a balancing disk interleaved with the disks of the first plurality and the disks of the second plurality, the balancing disk including an adjustably positioned balancing weight for compensating for the weight of the substrate.

24. The printer drum of claim 23 wherein the balancing disk comprises a disk of the leading edge assembly.

25. The printer drum of claim 23 wherein the balancing disk includes a central member having a first side and an opposing second side, a first ring rotatably mounted to the first side of the central member, and a second ring rotatably mounted to the second side of the central member.

26. The printer drum of claim 25 wherein the balancing weight comprises a first weight fixedly mounted to the first ring and a second weight fixedly mounted to the second ring.

27. A printer drum having an axis of rotation, comprising:

a leading edge assembly for holding a first end of a substrate, the leading edge assembly including a first plurality of interconnected disks, a trailing edge assembly for holding a second end of the substrate, the trailing edge assembly including a second plurality of interconnected disks, the second plurality of disks being interleaved with the first plurality of disks and rotatable relative to the first plurality of disks about the axis of rotation, and a rotation lock for preventing the disks of the trailing edge assembly from rotating with respect to the disks of the leading edge assembly, the rotation lock including a member engaging the trailing edge assembly and the leading edge assembly.

28. A printer drum having an axis of rotation, comprising:

a leading edge assembly for holding a first end of a substrate, the leading edge assembly including a first plurality of interconnected disks and a second plurality of interconnected disks, a first trailing edge assembly for holding a second end of the substrate, the first trailing edge assembly including a third plurality of interconnected disks, the third plurality of disks being interleaved with the first plurality of disks and rotatable relative to the first plurality of disks about the axis of rotation, and a second trailing edge assembly for holding the second end of the substrate, the second trailing edge assembly including a fourth plurality of interconnected disks, the fourth plurality of disks being interleaved with the second plurality of disks and rotatable relative to the leading edge assembly about the axis of rotation independent of the rotation of the third plurality of disks.

* * * * *

UNITED STATES PATENT AND TRADEMARK OFFICE

CERTIFICATE OF CORRECTION

PATENT NO. : 6,116,160 
DATED : September 12, 2000
INVENTOR(S) : Scott T. Burnett, James D. Roberge, Adam I. Pinard, Robert J. Bullock , David A. Parker It is certified that error appears in the above-identified patent and that said Letters Patent is hereby corrected as shown below:

Title page,
Title page should be deleted to appear as per attached title page.

Drawings,
Please replace Figs. 1-12 with attached Figs. 1-12.

Column 7,
Line 53, after "of", delete ";".

Signed and Sealed this

Twentieth Day of November, 2001

*Attest:*

Nicholas P. Godici

*Attesting Officer*

NICHOLAS P. GODICI
*Acting Director of the United States Patent and Trademark Office*

[54] PRINTER DRUM

[75] Inventors: Scott T. Burnett, Derry, N.H.; James D. Roberge, Westford, Mass.; Adam I. Pinard, Carlisle, Mass.; Robert J. Bullock, Acton, Mass.; David A. Parker, Dunstable, Mass.

[73] Assignee: IRIS Graphics, Inc., Bedford, Mass.

[21] Appl. No.: 09/042,032

[22] Filed: Mar. 13, 1998

[51] Int. Cl.[7] ..... B41F 13/10

[52] U.S. Cl. ..... 101/378; 101/415.1

[58] Field of Search ..... 101/375, 378, 101/382.1, 383, 407.1, 408, 409, 410, 415.1, 246; 492/25, 36, 38, 39, 40

[56] References Cited

U.S. PATENT DOCUMENTS

| | | | |
|---|---|---|---|
| 2,386,214 | 10/1945 | Harrold et al. . | |
| 2,844,123 | 7/1958 | Hayford . | |
| 3,154,012 | 10/1964 | Fischer . | |
| 3,217,644 | 11/1965 | Schmidt . | |
| 3,735,702 | 5/1973 | Kossak . | |
| 3,781,107 | 12/1973 | Ruhland . | |
| 4,018,158 | 4/1977 | Borneman . | |
| 4,024,814 | 5/1977 | Becker | 101/410 |
| 4,026,209 | 5/1977 | Wirz et al. | 101/410 |
| 4,135,198 | 1/1979 | Fujimoto . | |
| 4,191,106 | 3/1980 | Fermi et al. . | |
| 4,202,268 | 5/1980 | Becker . | |
| 4,204,471 | 5/1980 | Becker . | |
| 4,223,604 | 9/1980 | Brehm et al. . | |
| 4,225,872 | 9/1980 | Marinoff . | |
| 4,250,810 | 2/1981 | Fowler et al. . | |
| 4,304,182 | 12/1981 | Etchell et al. . | |
| 4,332,197 | 6/1982 | Dulin . | |
| 4,334,473 | 6/1982 | Becker et al. | 101/409 |
| 4,489,653 | 12/1984 | Cappel et al. . | |
| 4,864,931 | 9/1989 | Felkl et al. . | |
| 4,938,135 | 7/1990 | Wieland . | |
| 4,953,252 | 9/1990 | Akisawa . | |
| 5,052,299 | 10/1991 | Kojima . | |
| 5,086,701 | 2/1992 | Gasparrini et al. . | |
| 5,123,354 | 6/1992 | Loos . | |
| 5,181,469 | 1/1993 | Merkel et al. . | |
| 5,322,014 | 6/1994 | Keller . | |
| 5,325,778 | 7/1994 | Hartung et al. . | |
| 5,335,046 | 8/1994 | Bosy . | |
| 5,335,597 | 8/1994 | Helmstadter | 101/410 |
| 5,584,242 | 12/1996 | Fuller et al. . | |
| 5,685,226 | 11/1997 | Fuller . | |

FOREIGN PATENT DOCUMENTS

| | | | |
|---|---|---|---|
| 0005715 | 12/1979 | European Pat. Off. . | |
| 0236741 | 9/1987 | European Pat. Off. . | |
| 0 246 012 | 11/1987 | European Pat. Off. . | |
| 2 474 899 | 8/1981 | France . | |
| 609099 | 1/1935 | Germany . | |
| 2016847 | 12/1971 | Germany . | |
| 3319246 A1 | 12/1984 | Germany . | |
| 301351 A1 | 7/1985 | Germany . | |
| 29616704 | 11/1996 | Germany . | |
| 148058 | 7/1986 | Japan | 101/410 |
| 562687 | 6/1975 | Switzerland . | |

*Primary Examiner*—Ren Yan
*Attorney, Agent, or Firm*—Fish & Richardson, P.C.

[57] ABSTRACT

A printer drum includes a leading edge assembly for holding a first end of a substrate, and a trailing edge assembly for holding a second end of the substrate. The leading edge assembly includes a first plurality of interconnected disks, and the trailing edge assembly includes a second plurality of interconnected disks. The disks of the two assemblies are interleaved such that the disks of the trailing edge assembly are rotatable relative to the disks of the leading edge assembly about the axis of rotation of the drum. A balancing disk is interleaved with the disks. A leading edge clamp interconnects the first plurality of disks, and a trailing edge clamp interconnects the second plurality of disks. A plurality of registration pins of the leading edge clamp selectively engage a substrate held by the clamp.

28 Claims, 11 Drawing Sheets

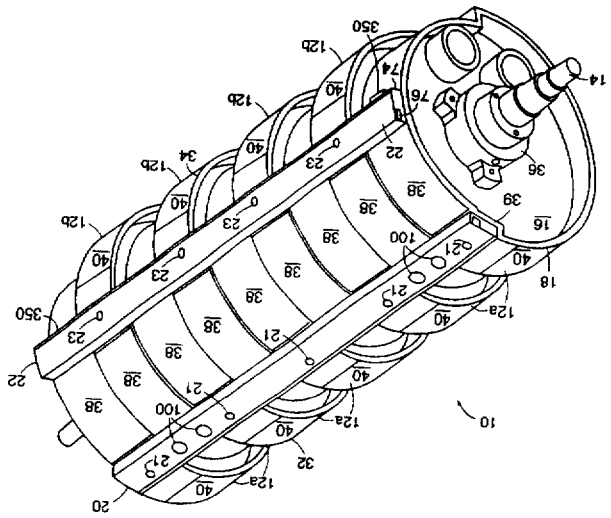

UNITED STATES PATENT AND TRADEMARK OFFICE

CERTIFICATE OF CORRECTION

PATENT NO. : 6,116,160
DATED : September 12, 2000
INVENTOR(S) : Scott T. Burnett, James D. Roberge, Adam I. Pinard, Robert J. Bullock, David A. Parker It is certified that error appears in the above-identified patent and that said Letters Patent is hereby corrected as shown below:

The title page should be deleted to appear as per attached title page.

Please replace Figs. 1-12 with attached Figs. 1-12.

Column 7,
Line 53, after "of" delete ";".

This certificate supercedes Certificate of Correction issued November 20, 2001.

Signed and Sealed this

Twenty-second Day of January, 2002

*Attest:*

*Attesting Officer*

JAMES E. ROGAN
*Director of the United States Patent and Trademark Office*

United States Patent [19]

Burnett et al.

[11] Patent Number: 6,116,160

[45] Date of Patent: Sep. 12, 2000

[54] PRINTER DRUM

[75] Inventors: Scott T. Burnett, Derry, N.H.; James D. Roberge, Westford, Mass.; Adam I. Pinard, Carlisle, Mass.; Robert J. Bullock, Acton, Mass.; David A. Parker, Dunstable, Mass.

[73] Assignee: IRIS Graphics, Inc., Bedford, Mass.

[21] Appl. No.: 09/042,032

[22] Filed: Mar. 13, 1998

[51] Int. Cl.[7] ..... B41F 13/10

[52] U.S. Cl. ..... 101/378; 101/415.1

[58] Field of Search ..... 101/375, 378, 101/382.1, 383, 407.1, 408, 409, 410, 415.1, 246; 492/25, 36, 38, 39, 40

[56] References Cited

U.S. PATENT DOCUMENTS

| | | | |
|---|---|---|---|
| 2,386,214 | 10/1945 | Harrold et al. . | |
| 2,844,123 | 7/1958 | Hayford . | |
| 3,154,012 | 10/1964 | Fischer . | |
| 3,217,644 | 11/1965 | Schmidt . | |
| 3,735,702 | 5/1973 | Kossak . | |
| 3,781,107 | 12/1973 | Ruhland . | |
| 4,018,158 | 4/1977 | Borneman . | |
| 4,024,814 | 5/1977 | Becker | 101/410 |
| 4,026,209 | 5/1977 | Wirz et al. | 101/410 |
| 4,135,198 | 1/1979 | Fujimoto . | |
| 4,191,106 | 3/1980 | Fermi et al. . | |
| 4,202,268 | 5/1980 | Becker . | |
| 4,204,471 | 5/1980 | Becker . | |
| 4,223,604 | 9/1980 | Brehm et al. . | |
| 4,225,872 | 9/1980 | Marinoff . | |
| 4,250,810 | 2/1981 | Fowler et al. . | |
| 4,304,182 | 12/1981 | Etchell et al. . | |
| 4,332,197 | 6/1982 | Dulin . | |
| 4,334,473 | 6/1982 | Becker et al. | 101/409 |
| 4,489,653 | 12/1984 | Cappel et al. . | |
| 4,864,931 | 9/1989 | Felkl et al. . | |
| 4,938,135 | 7/1990 | Wieland . | |
| 4,953,252 | 9/1990 | Akisawa . | |
| 5,052,299 | 10/1991 | Kojima . | |
| 5,086,701 | 2/1992 | Gasparrini et al. . | |
| 5,123,354 | 6/1992 | Loos . | |
| 5,181,469 | 1/1993 | Merkel et al. . | |
| 5,322,014 | 6/1994 | Keller . | |
| 5,325,778 | 7/1994 | Hartung et al. . | |
| 5,335,046 | 8/1994 | Bosy . | |
| 5,335,597 | 8/1994 | Helmstadter | 101/410 |
| 5,584,242 | 12/1996 | Fuller et al. . | |
| 5,685,226 | 11/1997 | Fuller . | |

FOREIGN PATENT DOCUMENTS

| | | | |
|---|---|---|---|
| 0005715 | 12/1979 | European Pat. Off. . | |
| 0236741 | 9/1987 | European Pat. Off. . | |
| 0 246 012 | 11/1987 | European Pat. Off. . | |
| 2 474 899 | 8/1981 | France . | |
| 609099 | 1/1935 | Germany . | |
| 2016847 | 12/1971 | Germany . | |
| 3319246 A1 | 12/1984 | Germany . | |
| 301351 A1 | 7/1985 | Germany . | |
| 29616704 | 11/1996 | Germany . | |
| 148058 | 7/1986 | Japan | 101/410 |
| 562687 | 6/1975 | Switzerland . | |

*Primary Examiner*—Ren Yan

*Attorney, Agent, or Firm*—Fish & Richardson, P.C.

[57] ABSTRACT

A printer drum includes a leading edge assembly for holding a first end of a substrate, and a trailing edge assembly for holding a second end of the substrate. The leading edge assembly includes a first plurality of interconnected disks, and the trailing edge assembly includes a second plurality of interconnected disks. The disks of the two assemblies are interleaved such that the disks of the trailing edge assembly are rotatable relative to the disks of the leading edge assembly about the axis of rotation of the drum. A balancing disk is interleaved with the disks. A leading edge clamp interconnects the first plurality of disks, and a trailing edge clamp interconnects the second plurality of disks. A plurality of registration pins of the leading edge clamp selectively engage a substrate held by the clamp.

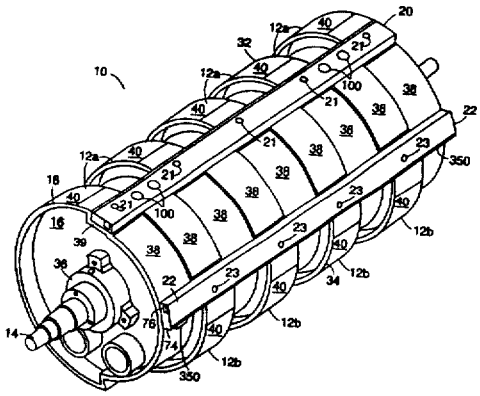

28 Claims, 11 Drawing Sheets